US009353616B2

(12) United States Patent
Richards et al.

(10) Patent No.: US 9,353,616 B2
(45) Date of Patent: May 31, 2016

(54) IN-LINE SAND SCREEN GAUGE CARRIER AND SENSING METHOD

(71) Applicants: William Mark Richards, Flower Mound, TX (US); Thomas Jules Frosell, Irving, TX (US)

(72) Inventors: William Mark Richards, Flower Mound, TX (US); Thomas Jules Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 135 days.

(21) Appl. No.: 14/003,451

(22) PCT Filed: Sep. 26, 2012

(86) PCT No.: PCT/US2012/057278
§ 371 (c)(1),
(2) Date: Sep. 5, 2013

(87) PCT Pub. No.: WO2014/051568
PCT Pub. Date: Apr. 3, 2014

(65) Prior Publication Data
US 2014/0083686 A1 Mar. 27, 2014

(51) Int. Cl.
*E21B 47/00* (2012.01)
*E21B 47/12* (2012.01)
*E21B 47/01* (2012.01)
*E21B 47/06* (2012.01)

(52) U.S. Cl.
CPC ..... *E21B 47/00* (2013.01); *E21B 47/01* (2013.01); *E21B 47/06* (2013.01)

(58) Field of Classification Search
CPC ..... E21B 47/00; E21B 47/12
See application file for complete search history.

(56) References Cited

U.S. PATENT DOCUMENTS

| | | | |
|---|---|---|---|
| 4,615,388 | A | 10/1986 | Walhaug et al. |
| 4,628,995 | A | 12/1986 | Young et al. |
| 4,678,035 | A | 7/1987 | Goldschild |
| 4,806,928 | A | 2/1989 | Veneruso |
| 4,949,788 | A | 8/1990 | Szarka et al. |
| 5,547,029 | A | 8/1996 | Rubbo et al. |
| 5,921,318 | A | 7/1999 | Ross |
| 6,247,536 | B1 | 6/2001 | Leismer et al. |
| 6,253,857 | B1 | 7/2001 | Gano |

(Continued)

FOREIGN PATENT DOCUMENTS

| | | | |
|---|---|---|---|
| WO | 03/080993 | A1 | 10/2003 |
| WO | 2005/045174 | A2 | 5/2005 |
| WO | 2012/112657 | A2 | 8/2012 |

OTHER PUBLICATIONS

Search Report and Written Opinion cited in International Application No. PCT/US2012/057220 dated Apr. 8, 2013.

(Continued)

*Primary Examiner* — Catherine Loikith
(74) *Attorney, Agent, or Firm* — Scott Richardson; Baker Botts L.L.P.

(57) ABSTRACT

A wellbore sensing system comprises a wellbore tubular string comprising at least one gauge carrier and at least one adjacent component, and at least one gauge disposed in the gauge carrier. The at least one gauge carrier is configured to provide an annular fluid communication between a housing and a mandrel, and the at least one gauge carrier is sealingly engaged with the at least one adjacent component. The at least one adjacent component comprises at least one of a filter element or a production sleeve, and the at least one gauge is configured to sense at least one parameter within a wellbore.

19 Claims, 13 Drawing Sheets

(56) References Cited

U.S. PATENT DOCUMENTS

| | | | | |
|---|---|---|---|---|
| 6,257,332 | B1 | 7/2001 | Vidrine et al. | |
| 6,257,338 | B1 | 7/2001 | Kilgore | |
| 6,279,660 | B1 | 8/2001 | Hay | |
| 6,446,729 | B1 | 9/2002 | Bixenman et al. | |
| 6,523,609 | B1 | 2/2003 | Miszewski | |
| 6,575,237 | B2 | 6/2003 | Purkis et al. | |
| 6,629,564 | B1 | 10/2003 | Ramakrishnan et al. | |
| 6,655,452 | B2 | 12/2003 | Zillinger | |
| 6,684,951 | B2 | 2/2004 | Restarick et al. | |
| 6,712,149 | B2 | 3/2004 | Leismer et al. | |
| 6,942,043 | B2 | 9/2005 | Kurkoski | |
| 6,983,796 | B2 | 1/2006 | Bayne et al. | |
| 6,995,352 | B2 * | 2/2006 | Hay | E21B 34/14 250/227.14 |
| 7,055,598 | B2 | 6/2006 | Ross et al. | |
| 7,165,892 | B2 | 1/2007 | Grigsby et al. | |
| 7,222,676 | B2 | 5/2007 | Patel et al. | |
| 7,228,912 | B2 | 6/2007 | Patel et al. | |
| 7,273,106 | B2 | 9/2007 | Huckabee et al. | |
| 7,278,486 | B2 | 10/2007 | Alba et al. | |
| 7,306,043 | B2 | 12/2007 | Toekje et al. | |
| 7,377,321 | B2 | 5/2008 | Rytlewski | |
| 7,428,932 | B1 | 9/2008 | Wintill et al. | |
| 7,735,555 | B2 | 6/2010 | Patel et al. | |
| 7,900,705 | B2 | 3/2011 | Patel | |
| 7,950,454 | B2 | 5/2011 | Patel et al. | |
| 7,950,461 | B2 | 5/2011 | Schrader et al. | |
| 7,966,875 | B2 | 6/2011 | Proett et al. | |
| 8,079,419 | B2 | 12/2011 | Richards | |
| 8,082,998 | B2 | 12/2011 | Richards | |
| 8,196,668 | B2 | 6/2012 | Rytlewski et al. | |
| 2002/0109080 | A1 | 8/2002 | Tubel et al. | |
| 2003/0079878 | A1 | 5/2003 | Pramann et al. | |
| 2003/0221829 | A1 | 12/2003 | Patel et al. | |
| 2003/0226665 | A1 | 12/2003 | Jones et al. | |
| 2004/0035591 | A1 | 2/2004 | Echols | |
| 2004/0173363 | A1 | 9/2004 | Navarro-Sorroche | |
| 2004/0262011 | A1 | 12/2004 | Huckabee et al. | |
| 2006/0196660 | A1 | 9/2006 | Patel | |
| 2007/0007005 | A1 | 1/2007 | Heller et al. | |
| 2007/0235185 | A1 | 10/2007 | Patel et al. | |
| 2008/0257544 | A1 | 10/2008 | Thigpen et al. | |
| 2009/0188665 | A1 | 7/2009 | Tubel et al. | |
| 2009/0260835 | A1 | 10/2009 | Malone | |
| 2009/0283272 | A1 | 11/2009 | Amaral et al. | |
| 2009/0288824 | A1 | 11/2009 | Fowler, Jr. et al. | |
| 2010/0038093 | A1 | 2/2010 | Patel | |
| 2010/0139909 | A1 | 6/2010 | Tirado et al. | |
| 2010/0175894 | A1 | 7/2010 | Debard et al. | |
| 2010/0193182 | A1 | 8/2010 | Levy | |
| 2010/0212963 | A1 | 8/2010 | Gopalan et al. | |
| 2010/0243270 | A1 | 9/2010 | Ingram et al. | |
| 2011/0011577 | A1 | 1/2011 | Dusterhoft et al. | |
| 2011/0024105 | A1 * | 2/2011 | Hammer | E21B 34/14 166/113 |
| 2011/0061862 | A1 | 3/2011 | Loretz et al. | |
| 2011/0061875 | A1 | 3/2011 | Tips et al. | |
| 2011/0108287 | A1 | 5/2011 | Richards | |
| 2011/0120726 | A1 | 5/2011 | Murray et al. | |
| 2011/0132601 | A1 | 6/2011 | Pettinato et al. | |
| 2011/0209873 | A1 | 9/2011 | Stout | |
| 2011/0214883 | A1 | 9/2011 | Patel | |
| 2012/0024520 | A1 | 2/2012 | Fripp et al. | |
| 2012/0181043 | A1 | 7/2012 | Patel | |
| 2012/0181045 | A1 | 7/2012 | Thomas et al. | |
| 2012/0199346 | A1 | 8/2012 | Patel et al. | |
| 2012/0222860 | A1 | 9/2012 | Kalman et al. | |
| 2012/0325484 | A1 | 12/2012 | Patel | |

OTHER PUBLICATIONS

Search Report and Written Opinion cited in International Application No. PCT/US2012/057257 dated Apr. 23, 2013.

Search Report and Written Opinion cited in International Application No. PCT/US2012/057283 dated Apr. 23, 2013.

Search Report and Written Opinion cited in International Application No. PCT/US2012/057215 dated Apr. 25, 2013.

Search Report and Written Opinion cited in International Application No. PCT/US2012/057241 dated Apr. 29, 2013.

Halliburton Energy Services, Inc., "Sand Control Systems", H06382, company article dated Jul. 2009, 6 pages.

Search Report and Written Opinion cited in International Appl. No. PCT/US2012/057231 dated Apr. 23, 2013.

Halliburton Energy Services, Inc. "IV Series Interval Control Valves," H06972 dated Aug. 2009, 2 pages.

Halliburton Energy Services, Inc. "Scrams", H06976, Feb. 2012, 2 pages.

Halliburton Energy Services, Inc. "Long Space-Out Travel Joint (LSOTJ)," H08460, dated Dec. 2011, 2 pages.

Halliburton Brochure entitled "Sand Control Systems, Enhanced Single Trip Multizone (ESMTZ tm) System", H06382, 2009.

Mazerov, "GOM Completions: Innovation Filling in Technology Gaps at Nearly Six Miles Under," reprinted from the May/Jun. 2009 edition of Drilling Contractor Magazine.

Specification and Drawings for U.S. Appl. No. 13/913,111, filed Jun. 7, 2013, 47 pages.

Specification and Drawings for U.S. Appl. No. 13/950,674, filed Jul. 25, 2013, 44 pages.

Office Action issued Oct. 4, 2013 in U.S. Appl. No. 13/913,111, 23 pages.

Office Action issued Oct. 4, 2013 in U.S. Appl. No. 13/918,077, 15 pages.

Office Action issued Dec. 20, 2013 for U.S. Appl. No. 13/950,674, 22 pages.

Office Action issued Feb. 10, 2014 for U.S. Appl. No. 13/913,111, 21 pages.

Office Action issued Apr. 15, 2014 in U.S. Appl. No. 13/913,111, 22 pages.

Office Action issued Apr. 10, 2014 in U.S. Appl. No. 13/918,077, 26 pages.

Office Action issued Mar. 12, 2014 in U.S. Appl. No. 13/950,674, 14 pages.

Office Action issued May 28, 2014 in U.S. Appl. No. 13/894,830, 24 pages.

Office Action issued Apr. 30, 2014 in U.S. Appl. No. 13/988,139, 14 pages.

Office Action issued Apr. 2, 2014 in U.S. Appl. No. 13/896,887, 7 pages.

Office Action issued May 6, 2014 in U.S. Appl. No. 13/988,099, 17 pages.

Office Action issued Jun. 19, 2014 in U.S. Appl. No. 13/979,137, 10 pages.

Foreign Communication from a Related Counterpart Application, "International Search Report and Written Opinion" dated Apr. 26, 2013, International Application No. PCT/US12/57271 filed on Sep. 26, 2012.

Foreign Communication from a Related Counterpart Application, "International Search Report and Written Opinion" dated May 8, 2013, International Application No. PCT/US12/57278 filed on Sep. 26, 2012.

International Search Report and Written Opinion issued in related PCT Application No. PCT/US2012/057266, mailed on Apr. 26, 2013 (10 pages).

International Preliminary Report on Patentability issued in related PCT Application No. PCT/US2012/057266, mailed Apr. 9, 2015 (9 pages).

Office Action issued in related Australian patent application No. 2012391063, issued Nov. 28, 2015 (3 pages).

Office Action issued in related Australian patent application No. 2012391061, issued Nov. 23, 2015 (3 pages).

* cited by examiner

IN-LINE SAND SCREEN GAUGE CARRIER AND SENSING METHOD

CROSS-REFERENCE TO RELATED APPLICATIONS

This application is a 35 U.S.C. 371 National Stage of and claims priority to International Application No. PCT/US12/57278, filed Sep. 26, 2012, entitled "IN-LINE SAND SCREEN GAUGE CARRIER," which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are drilled through subterranean formations to allow hydrocarbons to be produced. In a typical completion, a completion/production assembly may be disposed within the wellbore when it is desired to produce hydrocarbons or other fluids. In some instances, the operation of the assembly can be affected by the operating parameters within the wellbore. Various sensors may be used to measure and or determine the relevant parameters. For example, sensors can be used in a wellbore and/or on a wellbore tubular member to measure temperature and/or pressure. The resulting sensor data can then be used to provide information about the wellbore and the production status.

SUMMARY

In an embodiment, a wellbore sensing system comprises a wellbore tubular string comprising at least one gauge carrier and at least one adjacent component, and at least one gauge disposed in the gauge carrier. The at least one gauge carrier is configured to provide an annular fluid communication between a housing and a mandrel, and the at least one gauge carrier is sealingly engaged with the at least one adjacent component. The at least one adjacent component comprises at least one of a filter element or a production sleeve, and the at least one gauge is configured to sense at least one parameter within a wellbore.

In an embodiment, a gauge carrier comprises a housing disposed about a mandrel, an annular space formed between the housing and the mandrel, and at least one pocket configured to receive a gauge. The annular space is configured to provide fluid communication between a first end of the housing and a second end of the housing, and the pocket is disposed on an outside of the housing. The housing is configured to substantially seal the at least one pocket from the annular space.

In an embodiment, a method of sensing in a wellbore comprises retaining at least one gauge along a wellbore tubular string using a gauge carrier, communicating fluid through the annular flowpath, and sensing at least one parameter using the at least one gauge. The gauge carrier comprises a housing disposed about a mandrel, and an annular flowpath is formed between the housing and the mandrel. The at least one parameter is provided through a sensing link from a point axially separate from the gauge carrier.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1A:
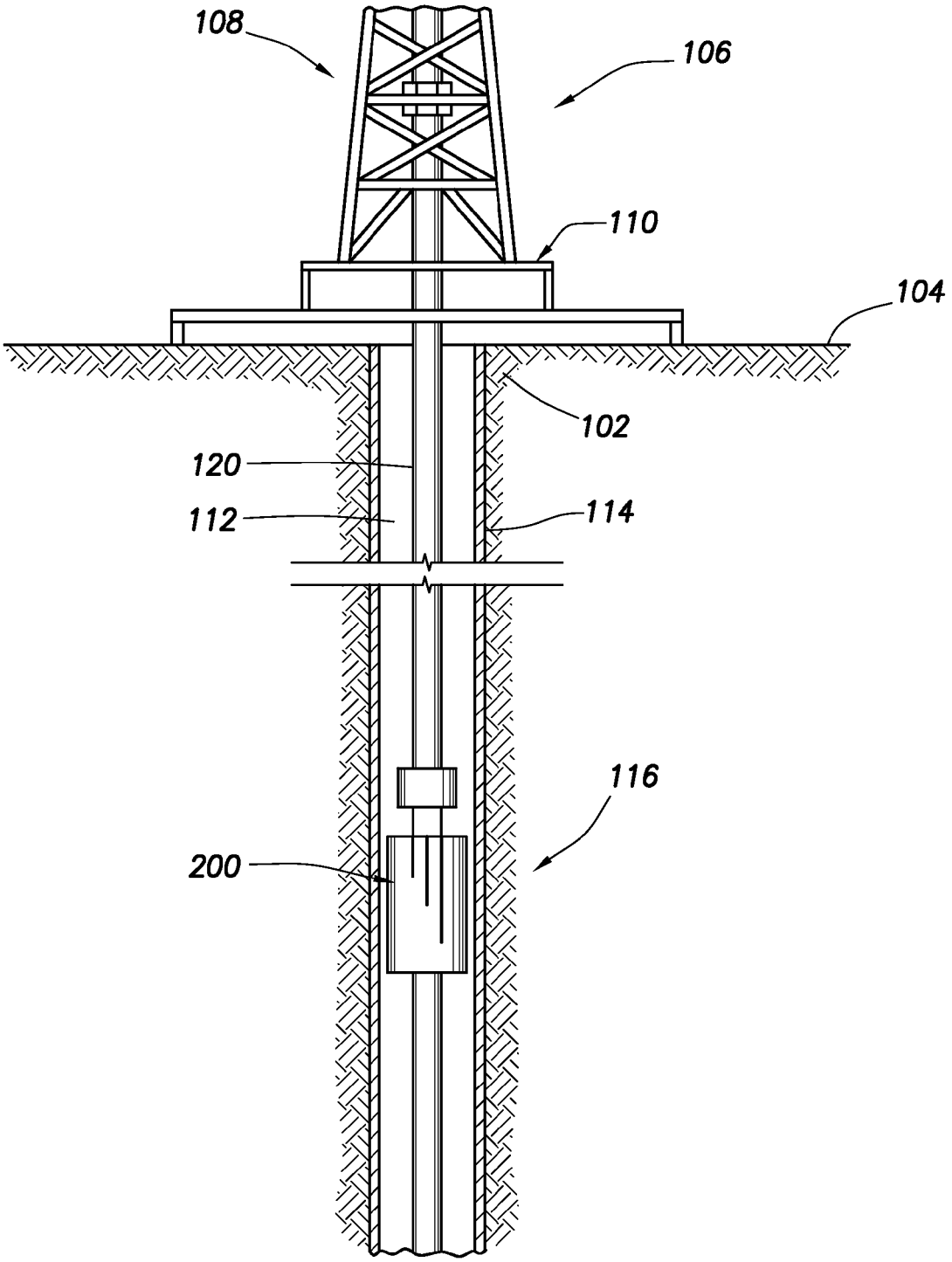
FIG. 1A is a cut-away view of an embodiment of a wellbore servicing system.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. The term "zone" or "pay zone" as used herein refers to separate parts of the wellbore designated for treatment or production and may refer to an entire hydrocarbon formation or separate portions of a single formation, for example, separated by one or more zonal isolation device, such as horizontally and/or vertically spaced portions of the same formation. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Sensing devices may be used to sense various parameters at various locations within a wellbore. For example, one or more sensors may be used to sense parameters within an annulus, at a packer, at the wellhead, and/or near sections of wellbore tubular members. The parameters may be used to configure a production assembly and allow for the efficient and effective production and/or injection of various fluids (e.g., hydrocarbons). In some embodiments, fluid production may generally flow from a subterranean formation through a filter, such as a production screen. Once the fluids pass through the filter, the fluids generally communicate through a passage into the production flow within the wellbore tubular. Various sensors can be used near, but not over, the filter to sense parameters such as pressure and/or temperature near the filter. One reason for the limitation on positioning the sensors is that close tolerances between the wellbore wall and the filter make locating sensors on the filters difficult, thereby limiting the locations that the various parameters can be detected along the production assembly. Additionally, debris within the wellbore annulus (e.g., at or near a filter) can clog a sensor disposed in radial alignment with a filter, thereby blocking the sensing element from obtaining an accurate reading.

Disclosed herein are apparatuses, assemblies, and systems that may allow for sensors to measure parameters across and/or within various wellbore components (e.g., a housing, a coupling, a shroud, a sleeve, a packer, a filter element, etc.) that are separated from one or more gauges within the wellbore. For example, it may be desirable to measure the pressure over a filter of a sand screen assembly, but a pressure gauge may not fit between the filter element (e.g., a screen) and the wellbore wall. In order to extend the reach of the pressure gauge, a fluid communication line (e.g., a snorkel tube) may be coupled to the gauge and installed over the filter element. The pressure may be communicated through the fluid communication line from the filter element to the gauge so that the pressure may be measured. Any number of fluid communication lines may be coupled to one or more gauges to provide a desired number of pressure readings over the filter element. Thus, the combination of the gauge and fluid communication line may be used to measure the pressure over a component, where the pressure gauge would otherwise not fit between the filter element and the wellbore wall. Further, one or more fluid communication lines may be used to provide fluid communication with any portion of a wellbore tubular string or wellbore component. For example, the fluid communication line may be ported to the inner diameter (e.g., a central flowpath) of a wellbore tubular string to provide a pressure measurement of the fluid within the wellbore tubular, and the gauge itself may be axially distanced from the measurement point.

Similarly, it may be desirable to measure the temperature at or near various components. For example, the temperature of a fluid adjacent a filter of a sand screen assembly may be measured, but the temperature gauge may not be capable of being located between the filter element and the wellbore wall. The temperature gauge may then be axially separated from the filter element, and an electrical line may extend over the filter element and be coupled to a temperature sensor (e.g., a thermocouple). The thermocouple may generate a voltage or other signal that can be communicated back to the temperature gauge so that the temperature can be measured at the location of the sensor. Any number of electric lines may be coupled to one or more temperature gauges to provide a desired number of temperature readings over the filter element using the electrical lines. This may allow the temperature sensor to be axially separated from the filter element while still measuring the temperature over the filter element.

While described in terms of a pressure and/or temperature gauge, any number of parameters may be measured using a sensing system that may not be able to be located between a wellbore component and the wellbore wall. For example, various gauges may sense a parameter such as, temperature, pressure, flow rate, compaction, stress, location, sound, fluid type, at least one seismic parameter, and/or vibration. The concept of remote sensing can then be generalized to any of these types of parameters so that a sensing system may comprise a gauge and sensing link (e.g., the fluid communication line, the electrical line, a fiber optic cable, etc.) coupled to the gauge. The gauge may be coupled to the sensing link to provide communication of a parameter from a second location to the first location where the gauge is located. The sensing link may be configured to communicate a parameter at or near a wellbore component to one or more gauges, for example at areas where tolerances are close and/or where the annular space would otherwise not allow a gauge to be disposed. In this embodiment, the gauge may be axially separated or spaced from a wellbore component and the sensing link may be used to extend out to the wellbore component, thereby allowing a measurement of a parameter at or near the wellbore component using a gauge disposed at a different location. The sensing link may comprise a cross-sectional area and/or shape configured to fit in a desired location, and the sensing link may provide a means of sensing one or more sensing points in radial alignment with the wellbore component.

The sensing link may serve to communicate a parameter from a location at or near a wellbore component to a gauge. Due to the presence of debris within the wellbore, the sensing link can clog and/or accumulate debris that may impair its ability to communicate the parameter to the gauge. For example, the fluid communication line used with a pressure sensor may become clogged with sand or gravel used in a gravel pack that can be placed about a sand screen assembly. In order to address this problem, a debris barrier may protect the sensing link from debris. The debris barrier may be disposed at a sensing point (e.g., the point at which the parameter is to be detected and/or measured) and generally comprises a housing and a barrier element. The housing may be coupled to a communication path through the sensing link and/or a communication medium disposed within the sensing link. The debris barrier may be configured to permit communication of a parameter between a fluid, such as production fluid, and the communication path. The debris barrier may also be configured to protect the communication path from debris. For example, the communication path may be configured to communicate a parameter from the sensing point to a gauge, and the parameter may communicate along the communication path through the communication medium. The housing and barrier element may provide an entry point for the communication path and protect the communication path from debris. The debris barrier may be coupled to a sensing assembly such as the sensing link. The debris barrier may be configured to protect the sensing assembly from damage caused by debris communicating through a wellbore and/or through a fluid production system. The debris barrier may also protect the sensing assembly and particularly the sensing link from debris blocking a sensing element, such as a sensing element disposed on and/or near a gauge, to obtain an accurate parameter reading.

In order to limit the separation between a gauge and a sensing point, the gauges may be disposed near the wellbore component or components. For example, the gauges may be mounted between adjacent wellbore components (e.g., filter elements) to place the gauges near the locations at which the various parameters are to be detected. However, when the gauges and/or a gauge carrier configured to retain the gauges are disposed along a production assembly, the gauges and/or gauge carrier may interrupt the flow of production fluids between the various components (e.g., between a filter element and a production sleeve, etc.). In order to allow the gauges to be disposed closer to the various wellbore components, a gauge carrier may be used that is configured to provide for annular flow between the gauge carrier and the wellbore tubular used to produce the fluids. The annular flow path may allow the gauge carrier to be disposed between adjacent wellbore components (e.g., between a filter element and a production sleeve, etc.). The gauge carrier may generally comprise a housing disposed about a mandrel (e.g., a wellbore tubular), at least one flow path between the housing and mandrel, and optionally, at least one pocket for retaining a gauge. The gauge carrier may be configured to sealingly engage with an adjacent component (e.g., a filter element or other component) to provide a continuous annular flow path along the wellbore. The gauge carrier may be configured to allow a gauge to be mounted in close proximity to a wellbore component, such as production screen, without prohibiting fluid communication between the wellbore component and a production flow path disposed within the wellbore tubular.

Turning to FIG. 1A, an embodiment in which such apparatus, assemblies, and/or systems may be utilized is illustrated. In the embodiment of FIG. 1 an example of a wellbore operating environment is shown. As depicted, the operating environment generally comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy.

A wellbore tubular string 120 comprising a sensing assembly 200 may be lowered into the subterranean formation 102 for a variety of workover or treatment procedures throughout the life of the wellbore. The embodiment, shown in FIG. 1, illustrates the wellbore tubular 120 in the form of a production string being lowered into the subterranean formation. It should be understood that the wellbore tubular 120 comprising a sensing assembly 200 is equally applicable to any type of wellbore tubular being inserted into a wellbore, including as non-limiting examples drill pipe, casing tubing, rod strings, and coiled tubing. The sensing assembly 200 may also be used to sense at least one parameter at or near various wellbore components such as subs, workover tools, completion tools, etc. In the embodiment shown in FIG. 1, the wellbore tubular 120 comprising a sensing assembly 200 is conveyed into the subterranean formation 102 in a conventional manner and may subsequently be secured within the wellbore 114 using any known retaining mechanisms (e.g., packers, hangers, etc.).

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the wellbore tubular 120 into the wellbore 114 to position the wellbore tubular 120 at a selected depth. While the operating environment depicted in FIG. 1 refers to a stationary drilling rig 106 for lowering and setting the wellbore tubular 120 comprising the sensing assembly 200 within a land-based wellbore 114, in alternative embodiments, mobile workover rigs, wellbore servicing units (such as coiled tubing units), and the like may be used to lower the wellbore tubular 120 comprising the sensing assembly 200 into a wellbore. It should be understood that a wellbore tubular 120 comprising the sensing assembly 200 may alternatively be used in other operational environments, such as within an offshore wellbore operational environment using, for example, an offshore drilling or production platform, floating drilling or production rig, or the like. In alternative operating environments, a vertical, deviated, or horizontal wellbore portion may be cased and cemented and/or portions of the wellbore may be uncased. For example, uncased section (e.g., uncased section 140 of FIG. 1B) may comprise a section of the wellbore 114 ready for being cased with wellbore tubular 120. In an embodiment, a sensing assembly 200 may be used on production tubing in a cased or uncased wellbore.

Figure 1B:
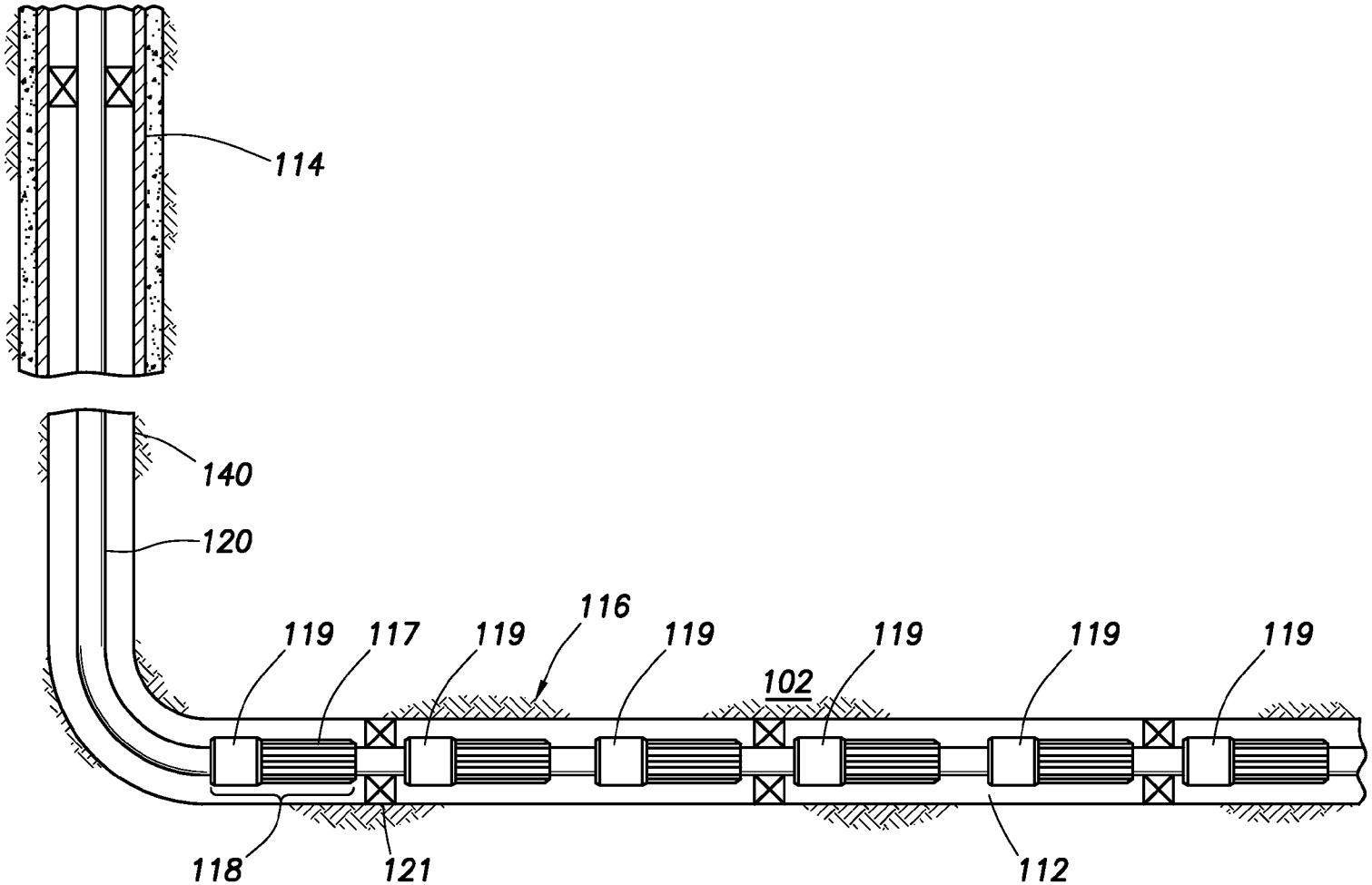
FIG. 1B is a cut-away view of an embodiment of a wellbore servicing system.

An embodiment of an operating environment in which the sensing assembly 200 may be used is shown in FIGS. 1A and 1B. In this embodiment, the operating environment may comprise a screen assembly 118. The screen assembly 118 may generally comprise a filter element 117 and/or a production sleeve 119. In some embodiments, a zonal isolation device 121 (e.g., a packer) may be used to isolate one or more zones within the wellbore and provide a multizone completion assembly. The filter element 117 may be configured to filter unwanted material from the subterranean formation 102 within a fluid flowing into the wellbore tubular 120. The filter element 117 may be disposed about the wellbore tubular 120 and can serve to limit and/or prevent the entry of sand, formation fines, and/or other particulate matter into the wellbore tubular 120. The filter element 117 may comprise a filter type known as "wire-wrapped," where wire is closely wrapped helically about wellbore tubular 120, with the spacing between each windings of wire designed to allow the passing of fluid but not of sand or other debris larger than a certain size. Other types of filters may also be used, such as sintered, mesh, pre-packed, expandable, slotted, perforated, and the like. It should be understood that the generic term "filter" or "filter element" as used herein is intended to include and cover all types of similar structures which are commonly used in screen assemblies and/or gravel pack well completions which permit the flow of fluids through the filter or screen while limiting and/or blocking the flow of particulates (e.g. other commercially-available screens, slotted or perforated liners or pipes; sintered-metal screens; sintered-sized, mesh screens; screened pipes; prepacked screens and/or liners; or combinations thereof).

Production sleeves 119 may be configured to selectively permit fluid communication, such as fluid communication of hydrocarbons, and/or meter the flow of fluids between the filter element 117 and a flow path, such as a central flow path, within the wellbore tubular 120. Zonal isolation devices 121 can isolate sections of the wellbore into different zones (as shown in FIG. 1B) or intervals along the wellbore 114 by providing a seal between the outer wall of the wellbore 114 and the wellbore tubular 120. The resulting screen assembly 118 may be used alone or in combination with a gravel pack. A gravel pack generally comprises gravel or sand disposed about a screen assembly within the wellbore, and the gravel pack may be configured to reduce the passage of particulates from the formation (e.g., formation sand) into the central flow path. The gravel pack may also be used to stabilize the formation while causing minimal impairment to well productivity. It should be understood that while the above components may form portions of a screen assembly 118, those of ordinary skill in the art would recognize other components that may be used in a screen assembly.

When particulates from the formation are expected to be encountered in a wellbore operating environment, one or more screen assemblies may be installed in the flow path between the production tubing and the perforated casing (cased) and/or the open well bore face (uncased). A packer is customarily set above the screen assembly to seal off the annulus in the zone where production fluids flow into the production tubing. The screen assembly can be expanded towards the casing/wellbore wall and/or the annulus around the screen assembly can be packed with a relatively coarse sand (or gravel) which acts as a filter to reduce the amount of fine formation sand reaching the screen. When a gravel pack is used, the packing sand can be pumped down the work string in a slurry of water and/or gel to fill the annulus between the screen assembly and the casing/wellbore wall. In well installations in which the screen is suspended in an uncased open bore, the sand or gravel pack may serve to support the surrounding unconsolidated formation.

Regardless of the type of operational environment in which the sensing assembly and/or sensing system 200 is used, it will be appreciated that the sensing assembly and/or sensing system 200 can be used to measure at least one parameter adjacent a section of a wellbore component (e.g., over or radially adjacent a filter element or screen). In an embodiment, the sensing assembly and/or sensing system 200 may be configured to measure a parameter at a location in a wellbore where the gauge may not fit. For example, the sensing assembly may be located at a location where it can be disposed and/or retained in a gauge carrier while a sensing link may allow for communication with a sensing point at a location at which the gauge may not fit. In an embodiment, the sensing system may be used to detect and/or measure various parameters including, but not limited to, temperature, pressure, flow rate, compaction, stress, location, sound, fluid type, at least one seismic parameter, and/or vibration.

Figure 2A:
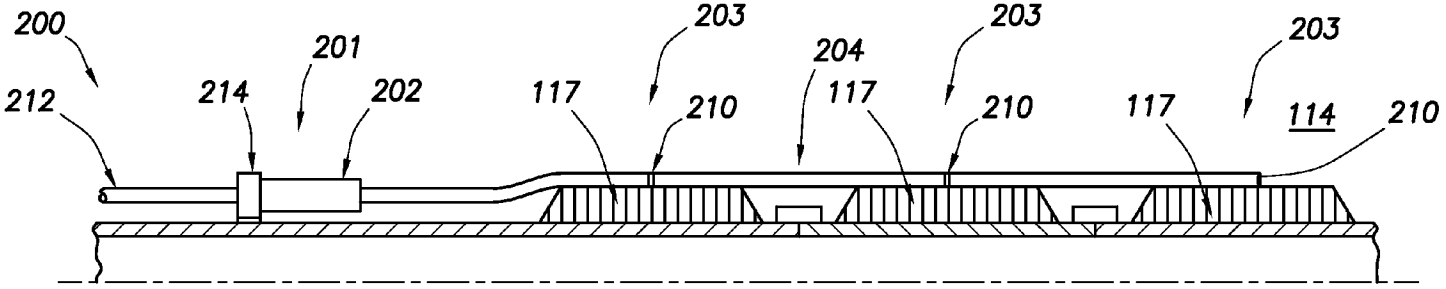
FIG. 2A is a schematic side view of an embodiment of a sensing system.
Figure 2B:
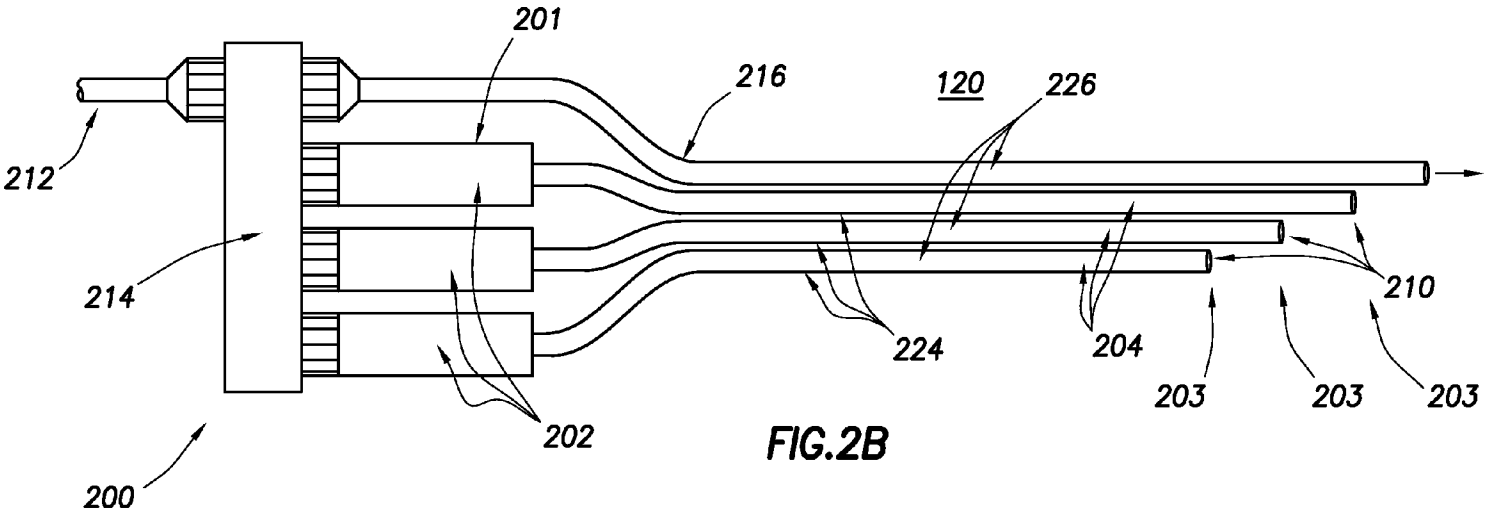
FIG. 2B is a schematic overhead view of an embodiment of a sensing system.

Representatively illustrated in FIGS. 2A and 2B, the sensing assembly and/or sensing system 200 may comprise at least one gauge 202 coupled to at least one sensing link 204. In an embodiment, the sensing assembly and/or sensing system 200 may comprise a gauge carrier 1000 (as shown in FIG. 10) for retaining the gauge 202 in position about the wellbore tubular while providing for an annular flow between adjacent components (e.g., between adjacent screen sections). The gauge carrier will be described in greater detail herein. In an embodiment, the sensing assembly and/or sensing system 200 may also comprise at least one manifold 214 coupled to one or more gauges 202. The manifold may serve to provide communication between a plurality of gauges 202 and another communication point using a reduced number of communication channels. For example, when a control line is used to provide communication between the manifold and the surface of the wellbore, the manifold may serve to collect, convert, and/or and serialize the communication from a plurality of gauges to allow the signals from a plurality of gauges to be transmitted over a reduced number of communication lines. In an embodiment, the manifold 214 may be disposed between a communication component 212 and one or more gauges 202, and the manifold 214 may serve to couple the communication component 212 to the one or more gauges 202. The sensing assembly and/or sensing system 200 may also comprise at least one bypass communication component 216 configured to engage a first sensing assembly and/or sensing system 200 with at least one other sensing assembly and/or sensing system 200 as well as the communication component 212. The bypass communication component 216 may engage with a first manifold 214 associated with the first sensing assembly and/or sensing system 200 and a second manifold 214 associated with the second sensing assembly 200. The bypass communication component 216 may comprise similar embodiments to the communication component 212.

As shown in FIGS. 2A and 2B, the sensing system 200 comprises at least one gauge 202 configured to sense parameter at a second location while being disposed at a first location 201 along the wellbore tubular string. The gauge 202 may be disposed outside of the wellbore tubular in in the annular region 112 between the wellbore tubular and the wellbore wall. The gauges can be configured to detect one or more parameters and provide an output signal indicative of the parameter. The output signal may then be communicated to another component (e.g., a manifold, communication component, telemetry tools, etc.), and the output signal may be used downhole and/or by a surface component. The gauge may be sized and/or disposed about the wellbore tubular to allow it to be disposed in the wellbore while being coupled to the wellbore tubular without being damaged during disposition within the wellbore. In an embodiment, a gauge carrier may be used to retain the gauge during and/or after disposition within the wellbore. When a plurality of gauges are present, the gauges may be disposed adjacent each other about the circumference of the wellbore tubular. For example, the gauges may be radially spaced about the circumference of the wellbore tubular. In an embodiment, the plurality of gauges may be coupled to each other and a communication component using a manifold 214.

Due to the size of the gauges, the first location may generally be disposed about the wellbore tubular at a location between the various components of the wellbore tubular string. For example, the first location may be disposed between one or more components including, but not limited to, filter elements, sleeves (e.g., production sleeves), zonal isolation devices (e.g., packers, plugs, etc.), housings, couplings, shrouds, etc. The first location 201 may be in a location that is not in radial alignment with another wellbore component other than a gauge carrier. For example, the first location 201 may be a location in radially alignment with only the wellbore tubular. In an embodiment, the first location 201 may not be in the same location as the second location 203, for example, the first location 201 may be longitudinally spaced apart from the second location 203.

In an embodiment, the gauge 202 may be configured to sense temperature, pressure, flow rate, compaction, stress, location, sound, fluid type, at least one seismic parameter, and/or vibration. In an embodiment, the gauge 202 may comprise a temperature gauge. Any suitable gauge configured to measure temperature may be used with the sensing assembly 200. In an embodiment, the temperature gauge may comprise a thermocouple, a resistance temperature detector (RTD), a thermistor, and/or any other means of measuring temperature. The temperature gauge 202 may comprise a design capable of operating in temperature ranging from between about 70 degrees Fahrenheit and about 390 degrees Fahrenheit, and the temperature gauge may operate in wellbore conditions up to about 500 degrees Fahrenheit. The gauge 202 may further comprise an accuracy rating range between about 0.02% FS and about 5.00% FS.

In an embodiment, the gauge 202 may comprise a pressure gauge. Any suitable gauge configured to measure pressure may be used with the sensing assembly 200. In an embodiment, the pressure gauge may comprise a piezo-resistive strain gauge, a capacitive pressure gauge, an electromagnetic pressure gauge, a piezoelectric gauge, a potentiometric gauge, a resonant gauge, a thermal gauge, an ionization gauge and/or any other means of measuring pressure. The gauge 202 may further comprise an accuracy rating range between about 0.02% FS and about 5.00% FS. In an embodiment, the gauge 202 may comprise a resolution rating range between about 0.01 psi/second and about 1.00 psi/second. The gauge 202 may comprise a design capable of operating in pressures ranging between about 10 psi and about 30,000 psi. The gauge 202 may comprise a hermetically-sealed electron beam-welded design with an inert gas filling.

Various other gauges such as electromagnetic sensors, logging tools, various seismic sensors (e.g., a hydrophone, a single-component geophone, a multi-component geophone, a single-axis accelerometer, a multi-axis accelerometer, or any combination thereof) may also be used to detect one or more parameters within the wellbore. In some embodiments, the gauge 202 may comprise a permanent downhole gauge. The gauge 202 may also comprise a quartz sensor-based design. In an embodiment, the gauge may comprise a ROC™ permanent monitoring gauge (available from Halliburton Energy Services, Inc. of Houston, Tex.). Additional suitable gauges are described in U.S. Pat. No. 7,784,350 issued Aug. 31, 2010 to Pelletier, which is incorporated herein by reference in its entirety.

As illustrated in FIGS. 2A and 2B, the communication component 212 may be configured to enable communication from the gauge 202 to a data receiving component using various communication mechanisms. The communication component 212 may comprise a device configured to transmit a signal from the gauge and/or the manifold to a remote location along with any communication medium used to transmit the signal. In an embodiment, the communication component 212 may comprise a control line configured to send a signal from a gauge 202 through at least one wire to the data receiving component. In some embodiments, the communication component 212 may also comprise wireless communication between a gauge 202 and a data receiving component. In an embodiment, wireless communication may comprise sending a wireless signal, sending a wave and/or pulse through a fluid (e.g., pressure based telemetry), and/or sending a physical indicator such as a flag and/or a ball between the sensing point and the data receiving component. For example, various telemetry systems may be used with the sensing system described herein to convey one or more parameters between the gauge and another location in the wellbore and/or the surface. In an embodiment, a fiber optic sensing system may be disposed with the sensing system 200, and the communication component 212 may comprise the fiber optic sensing system. The fiber optic sensing system may be used in conjunction with a communication component 212. The fiber optic sensing system uses a glass (e.g., silica) and/or plastic fiber configured to transmit light from one end of the fiber to the other end. The data from the gauge may be transmitted along the fiber to a receiver where it is converted into output data.

In an embodiment, the communication component 212 may be disposed between at least one wellbore tubular member and the wellbore wall, or in some embodiments, the communication component 212 may be disposed within a wellbore tubular member. The communication component 212 may be disposed and retained about the wellbore tubular member over at least a portion of the length between the at least one gauge 202 to the data receiving component. In an embodiment, the communication component 212 may comprise a plurality of communication components 212 disposed in parallel and/or in series with at least one other communication component 212. When a plurality of communication components 212 is disposed in series, the plurality of communication components 212 may comprise a bypass communication component 216 from another set of gauges or another manifold 214.

The data receiving component may receive the signal from the communication components, and the data receiving component may comprise a data storage device and/or a display. The data storage device may further comprise electronic hardware (e.g., a memory or storage device comprising a non-transitory computer readable media) to retain data. The data receiving component may comprise a device used to convert a signal to output data. The converting device may comprise hardware that converts a physical signal to output data. The data receiving component may be disposed within the wellbore, on the surface at a wellsite, at a remote location away from the wellsite, beneath the surface, and/or any combination thereof.

Continuing with FIGS. 2A and 2B, an embodiment of the sensing assembly and/or sensing system 200 further comprises at least one sensing link 204 configured to communicate a parameter from a second location 203 to the first location 201 at which the gauge 202 is disposed. The second location 203 may be radially adjacent a wellbore component, and in an embodiment, the second location 203 may be radially adjacent a filter element in a screen assembly. The sensing link may be smaller than the gauge, which may allow the sensing link to be disposed at a location where the gauge 202 may not fit. For example, the sensing link 204 may be sized to fit in a location where the gauge 202 may not fit such as adjacent various wellbore components including, but not limited to, filter elements, sleeves, zonal isolation devices, and the like.

In an embodiment, the cross-section of the sensing link 204 may comprise a circular, elliptical, rectangular, and/or polygonal shape. The sensing link 204 may be configured to be disposed over at least a portion of wellbore tubular member. The sensing link 204 may also be configured to be disposed within at least a portion of a wellbore tubular and/or provide a sensing point within at least a portion of a wellbore tubular. In an embodiment, the sensing link 204 may be extended from the gauge 202 in a first direction and/or a second direction along a wellbore tubular member. In an embodiment, the sensing link 204 may be used to sense a parameter in a plurality of directions from the gauge 202. For example, the first direction may be generally directed downwards, and the second direction may generally be directed upwards. In an embodiment, the sensing link 204 may be configured to couple to and/or communicate a plurality of parameters to one or more gauges. In some embodiments, a plurality of sensing links 204 may be coupled to a plurality of gauges 202. Each of the sensing links may communicate the same or different parameters, and each sensing link may have the same or different lengths. For example, a plurality of sensing links may be used with each one having a different length to provide an array of sensing points over or adjacent a wellbore component.

The structure of the sensing link may vary depending on the type of parameter being communicated between the first location 201 and second location 203. For example, when the sensing link 204 is communicating a pressure from the second location 203 to the first location 201, the sensing link 204 may comprise a component configured to provide fluid communication, and thereby fluid pressure, between the second location 203 and the first location 201. As another example, the sensed signal may be used to measure a temperature adjacent a wellbore component, and the sensing link 204 may comprise an electric line capable of communicating an output voltage from a temperature sensor (e.g., a thermocouple) from the second location 203 to the first location 201. In other embodiments, the sensing link 204 may comprise a fiber optic cable or the like. In some embodiments, the sensing link 204 may comprise a combination of coupling elements to allow a plurality of parameters to be communicated between the second location 203 and the first location 201.

Depending on the type of parameter being communicated between the second location 203 and the first location 201, the sensing link 204 may comprise one or more of a communication path, and/or a communication medium. In an embodiment, at least one communication path 224 may be configured to allow communication of a parameter from the second location 203 to the first location 201. In an embodiment, the communication path 224 may be configured to communicate an electrical signal, a compression force (e.g., a pressure signal, a seismic signal, etc.), a sound wave, a light wave, and/or any other parameter. In an embodiment, the communication path 224 may be coupled to a debris barrier, as described in further detail herein. In an embodiment, a parameter may be transmitted through a communication medium 226 configured to communicate the parameter from the sensing point 210 to the gauge. The communication medium may be contained within the communication path and/or form at least a portion of the communication path. The communication medium 226 may comprise a wire, a fluid (e.g., a liquid, grease, gel, etc.), an optical fiber, a waveguide, a thermal conductor, or any combination thereof.

As shown in FIGS. 2A and 2B, in an embodiment, the sensing link 204 may be configured to provide communication of a parameter (or a signal indicative of the parameter) between the second location and the first location. The second location may be referred to a sensing point, and in some embodiments, the sensing link may provide communication with a plurality of sensing points. In an embodiment, the sensing point 210 may be disposed at least at one point along the communication path 224, for example at the end of the communication path 224. In an embodiment, a plurality of sensing points 210 may be disposed at multiple locations along the communication path.

Figure 3:
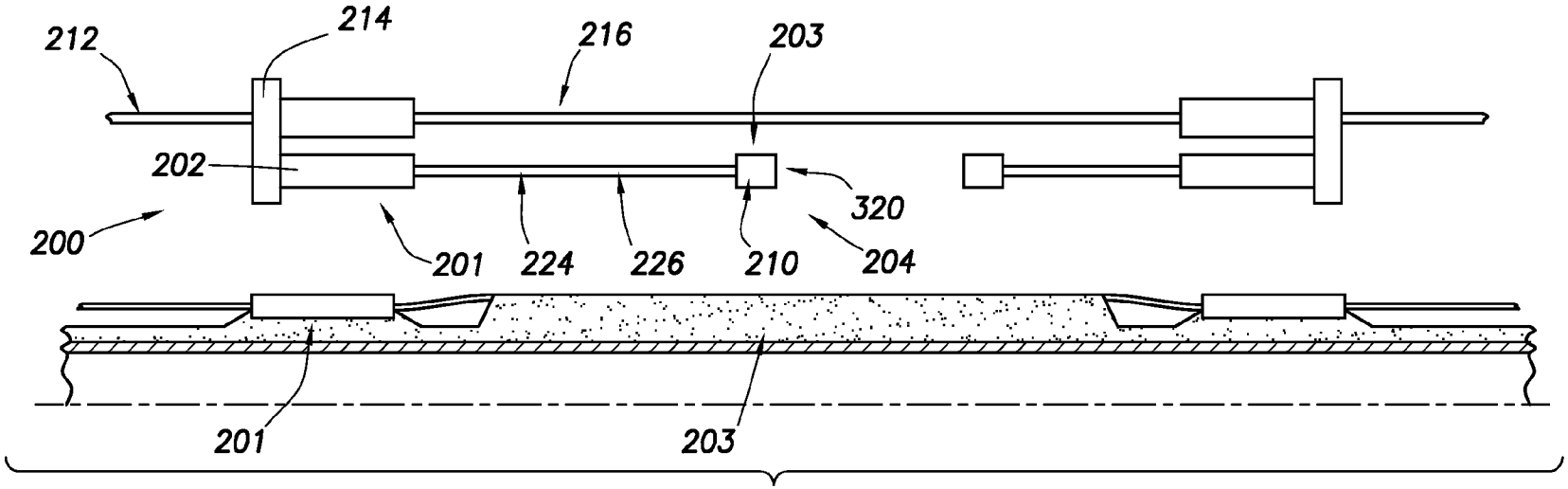
FIG. 3 is a schematic side view of an embodiment of a sensing system.

Turning to FIG. 3, a sensing assembly 200 comprising a sensing link 204 is shown. In this embodiment, the sensing link 204 may be configured at least for sensing a parameter at the second location. Similar to other sensing links 204, the embodiment in FIG. 3 depicts the sensing link 204 comprising a sensing point 210 and a communication path 224. A communication medium 226 may be disposed within the communication path 224. Additionally, in this embodiment, the sensing point 210 is disposed at the second location 203. Similar to other sensing assemblies and/or sensing systems 200, the embodiment in FIG. 3 depicts that the sensing assembly and/or sensing system 200 comprises a gauge 202 and, optionally, a communication component 212. The embodiment in FIG. 3 also depicts that the sensing assembly and/or sensing system 200 may also comprise a manifold 214 and a bypass line 216. The second location 203 is disposed over a wellbore component comprising a filter element and the gauge 202 is disposed adjacent the filter element, but not in radial alignment with the filter element. This arrangement may allow the gauge 202 to measure a parameter radially adjacent the filter element while not being located in radial alignment with the filter element itself.

In an embodiment, the gauge 202 may comprise at least one temperature gauge, which may be coupled to one or more temperature sensors 320. In an embodiment, the temperature sensor may be configured to detect the temperature at the sensing point 210. The temperature sensor may be exposed to the wellbore, and/or any number of intervening elements (e.g., covers, housings, etc.) may be used to provide indirect exposure to the wellbore temperature. In an embodiment, a plurality of temperature sensors 320 may be used along the length of the sensing link 204. The communication medium 226 may comprise at least one communication wire (not shown) and/or a plurality of communication wires. In an embodiment, the communication wire may be used to communicate at least one signal indicative of a temperature reading from at least one sensor 320, such as a temperature sensor, to at least one gauge 202, such as a temperature gauge. In an embodiment, the communication path 224 may be configured to permit the communication of a signal indicative of a temperature reading from the second location 203.

In an embodiment, the gauge 202 may comprise at least one pressure gauge. In an embodiment, pressure gauge 202 may be configured to detect pressure at the sensing point 210. The sensing point 210 may allow pressure to be transmitted between the wellbore and the communication path 224. The sensing point may be directly exposed to the wellbore, and/or any number of intervening elements (e.g., covers, housings, etc.) may be used to provide indirect exposure to the wellbore. In an embodiment, a plurality of openings may be disposed along a portion of the sensing link 204 to provide fluid communication between the plurality of points and one or more pressure gauges 202. As shown in FIG. 3, in an embodiment, the sensing point 210 may be disposed at the end of the sensing link 204, and/or the sensing point 210 may be disposed anywhere along the sensing link 204. The communication medium 226 may comprise a fluid. In an embodiment, the fluid may be used to communicate at least one signal indicative of a pressure reading from at least one sensing point to the at least one pressure gauge 202. In an embodiment, the communication path 224 may be configured to permit the communication of a pressure reading from a second location 203 to the gauge 202.

Figure 4A:
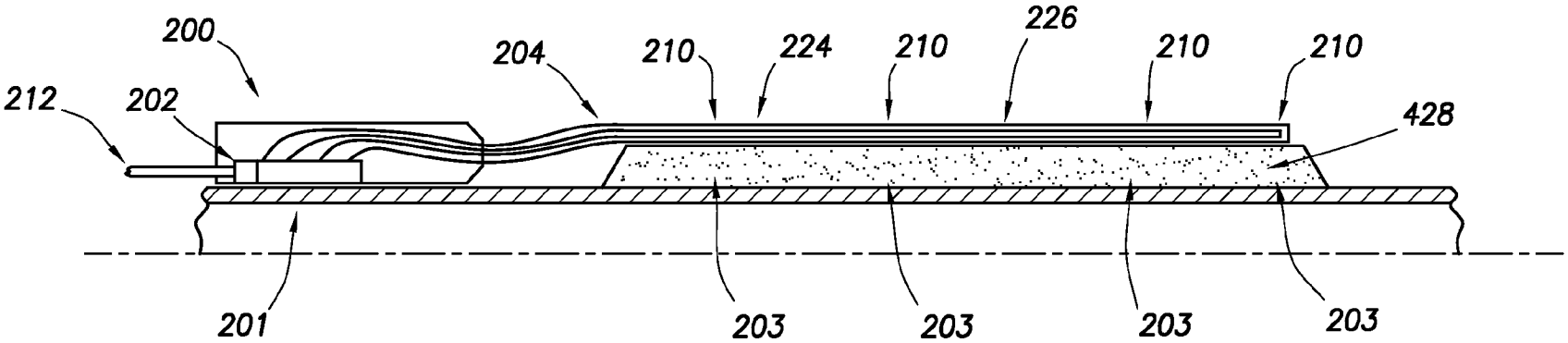
FIG. 4A is a schematic side view of an embodiment of a sensing system.

Turning to FIG. 4A, a sensing assembly 200 comprising a plurality of sensing links 204 is shown. Similar to FIG. 3, the sensing links 204 comprise at least one communication path 224 and communicate a parameter from at least one sensing point 210. Furthermore, similar to other embodiments, FIG. 4A depicts a sensing assembly and/or sensing systems 200 comprising a communication component 212. In this embodiment, multiple sensing points 210 are distributed longitudinally along a wellbore component 428. Additionally, the sensing points 210 are located at corresponding second locations 203 that are longitudinally separated from the first location 201. For example, the sensing links may comprise electrical conductors included in a single bundle of wires (e.g., a multi-conductor line). Individual wire pairs may be coupled to corresponding sensors (e.g., temperature sensors) to detect the temperature at various sensing points along the sensing link. In an embodiment, the sensing points may be distributed over a wellbore component to provide distributed temperature data along the wellbore component.

When a plurality of sensing links 204 are present in the sensing assembly, either separately or as a bundle, at least one sensing point 210 may be located within the wellbore component along which the sensing links are disposed (e.g., a filter element). In this embodiment, at least one sensing point 210 may be in radial alignment with another sensing point 210 disposed outside the wellbore component. Using this configuration, it may be possible, for example, to measure the temperature drop and/or pressure drop along the flow path of the wellbore component. Alternatively, in an embodiment, the sensing point 210 may be located within the wellbore component while not being in radial alignment with at least one other sensing point 210.

In an embodiment, the wellbore component comprises a filter element and at least one parameter may be measured adjacent the filter element. In an embodiment, a gauge 202 may be disposed at a first location along a wellbore tubular member, and the gauge 202 may be configured to sense at least one parameter. A communication path 224 configured to allow communication of at least one parameter from a second location to a first location may also be disposed along the wellbore tubular member. A sensing point 210 may be disposed at the second location. At least one parameter may be sensed and/or detected at the second location, where the second location is in radially adjacent a filter element 428. The at least one parameter may then be communicated through the communication path 224 using the communication medium 226 so that the gauge 202 may sense the parameter. As illustrated in FIG. 4A, a plurality of sensing links may provide communication of one or more parameters at a plurality of second locations along the filter element with the gauge 202. For example, a plurality of electric lines may be coupled to temperature sensors at a plurality of second locations and a temperature gauge 202 at the first location. This configuration may allow a single temperature gauge to measure a plurality of temperatures. In some embodiments, a plurality of sensing points may communicate a plurality of pressures to one or more pressure gauges at the first location. The sensing link may comprise a communication medium 226, which may be configured to communicate at least one parameter from a sensing point 210 to the gauge 202. At least one communication component may be coupled to the gauge 202, and the communication component may provide communication from the at least one gauge 202 to at least one remote location. Using the communication component 212, at least one signal generated in response to the gauge 202 sensing at least one parameter may be transmitted to the remote location.

In an embodiment, the wellbore component comprises a filter element, and at least one sensing point 210 may be disposed within the filter element. In this embodiment, a sensing point 210 may be disposed outside the filter element, and/or a sensing point 210 may be disposed inside the filter element 428. In some embodiments, a sensing point 210 may be in radial alignment with another sensing point 210. Using this configuration, it may be possible, for example, to measure the pressure and/or temperature drop across the filter element 428. Alternatively, in an embodiment, the sensing point 210 may be disposed within the filter element 428 while not being in radial alignment with at least one other sensing point 210.

Figure 4B:
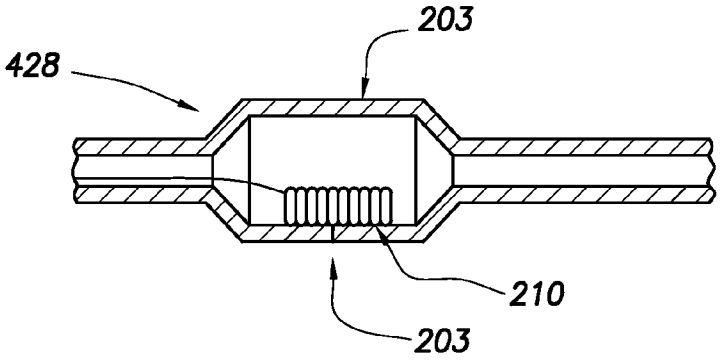
FIG. 4B is another schematic side view of an embodiment of a sensing system.

As shown in FIG. 4B, one or more sensors 210 may be placed in a housing along the length of the sensing link. In this embodiment, a plurality of sensing links may form a bundle, and the housings may comprise sensing points coupled to one or more of the sensing links. For example, temperature sensors may be disposed within the housings (e.g., fixedly disposed within the housings) along the length of a plurality of sensing links. The housings may be configured to retain the temperature sensors while providing thermal conduction to allow the temperature sensors to detect the temperature adjacent the housing. In this embodiment, the housing may be formed from various materials such as thermally conductive materials (e.g., various metals). The housings may then serve as discreet sensing points along the length of the sensing links. The use of the plurality of housings may provide an array of temperature sensing points along the length of the wellbore component.

Figure 5A:
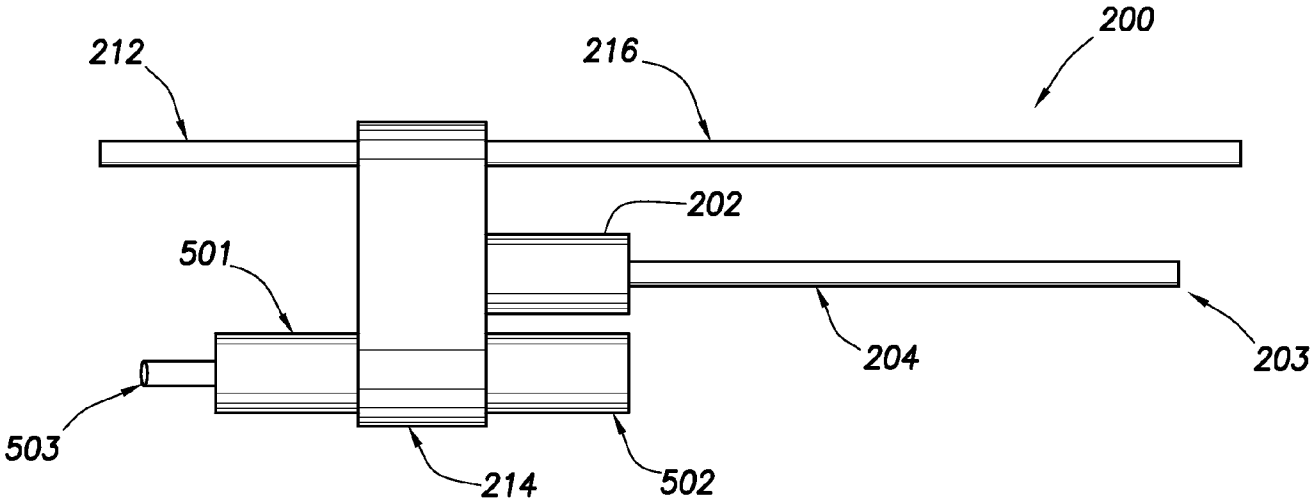
FIG. 5A is a schematic side view of an embodiment of a sensing system.
Figure 5B:
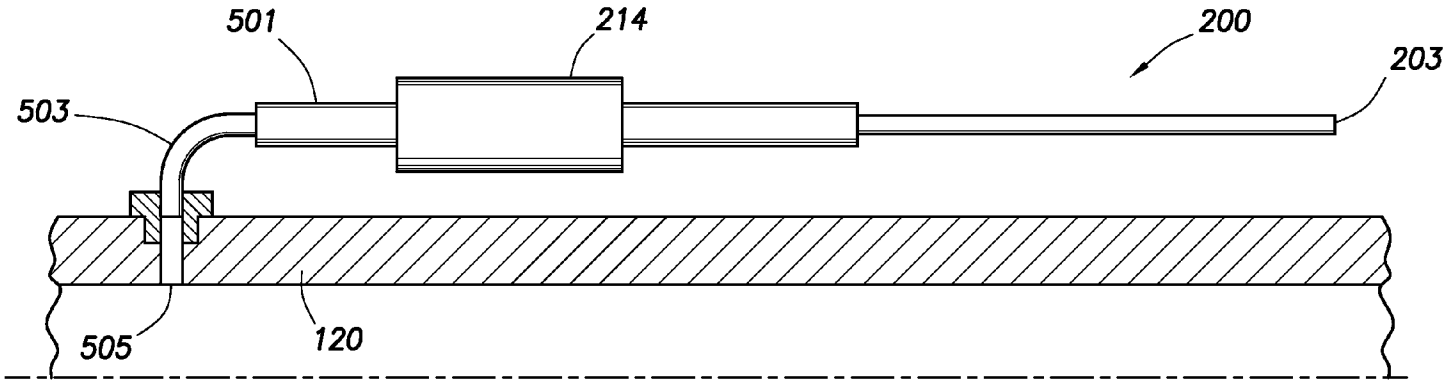
FIG. 5B is another schematic side view of an embodiment of a sensing system.

FIGS. 5A and 5B illustrate another sensing assembly 200 comprising a sensing link 204. The embodiment of the sensing assembly 200 illustrated in FIGS. 5A and 5B is similar to the sensing assembly of FIGS. 2A-3. In this embodiment, the sensing assembly may comprise a gauge 202 coupled to a sensing link 204 to provide communication of a parameter from a second location 203 to the gauge 202 disposed at a first location. In some embodiments, the sensing system may comprise a gauge 501 coupled to a sensing link 503 providing a sensing point within the wellbore tubular 120. The sensing link 503 may be used to communicate the pressure, temperature, flow rate, or any other parameter from within the wellbore tubular 120 to the gauge 501. While only a single sensing link 503 is illustrated, any plurality of sensing links may couple the gauge 501 to the wellbore tubular interior 120. While illustrated as providing a sensing point 505 within the wellbore tubular 120, the sensing link 503 may provide communication of a parameter between the gauge 501 and the interior of any wellbore component. For example, the sensing link 503 may provide a sensing point 505 within a production sleeve, a valve, an annular flow path, or the like. In an embodiment, the sensing point may be disposed within an annular flow path between a gauge carrier housing and a mandrel, as described in more detail herein. In this embodiment, the sensing link 503 may be used to communicate the pressure, temperature, flow rate, or any other parameter from within the annular flow path. It will be appreciated that the use of a gauge configured to measure one or more parameters within a wellbore tubular may be used with any of the embodiments of the sensing assembly disclosed herein.

In an embodiment as shown in FIGS. 5A and 5B, the sensing assembly 200 may comprise a gauge 502 configured to measure a parameter at the first location. When the gauge 502 measures the parameter at the first location (e.g., adjacent the gauge 502), a sensing link may not be coupled to the gauge 502. In an embodiment, the gauge 502 may comprises a temperature gauge, a pressure gauge, and/or any other suitable gauge for measuring a desired parameter. This configuration may allow a parameter to be measured at the first location, which may be useful in providing a parameter profile along the wellbore tubular string. For example, one or more temperature gauges may be coupled to sensing links used to measure the temperature across one or more wellbore components at a plurality of second locations 203 (e.g., a plurality of sensing points). In order to measure the temperature between the wellbore components, a temperature gauge may be configured to detect the temperature at the first location. The combined temperature readings at the first and second locations may then provide a profile along the wellbore tubular. A pressure profile may similarly be developed using a pressure gauge configured to detect the pressure at the first location along with one or more pressure gauges coupled to sensing links to measure the pressure at one or more second locations 203. It will be appreciated that the use of a gauge configured to measure one or more parameters at the first location may be used with any of the embodiments of the sensing assembly disclosed herein.

Figure 6:
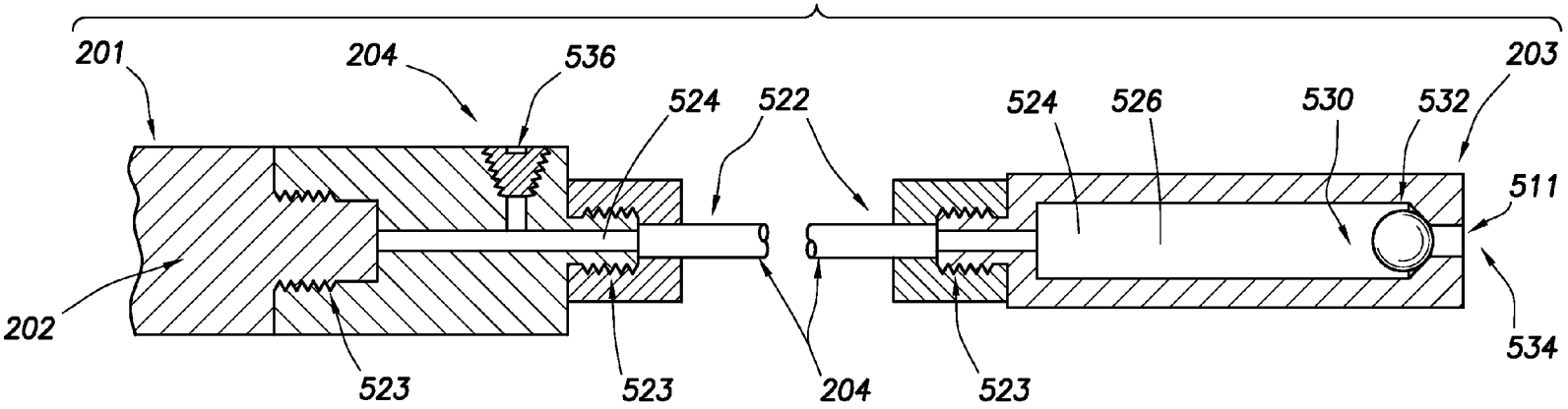
FIG. 6 is a cross-sectional view of an embodiment of a debris barrier.

Turning to FIG. 6, an embodiment of a debris barrier 522 is shown. The debris barrier 522 may be configured to protect a communication line (e.g., the sensing link 204) from debris within a wellbore. In an embodiment, the debris barrier 522 comprises a housing and a barrier element 530, where the housing may be coupled to a communication path 524. The debris barrier may serve as the sensing point when coupled to a sensing link 204 as described herein. The debris barrier may be used to reduce the amount of debris engaging any of the sensors described herein and/or any of the types of sensing links described herein.

In an embodiment, the debris barrier housing and the barrier element may be configured to shield the communication path 524 from debris within a wellbore. In an embodiment, the debris barrier housing may be coupled to communication path 524 or at least a portion of the communication path 524. The debris barrier housing may comprise one or more openings to allow the communication of the parameter to the interior of the housing. The barrier element 530 may be used to reduce the entry of debris into the one or more openings, thereby reducing the amount of debris entering the housing. For example, when the pressure within the wellbore is being measured, the debris barrier may comprise one or more openings to provide fluid communication with the wellbore, thereby allowing the pressure to be communicated to the interior of the debris barrier. The barrier element 530 may be disposed within or adjacent the one or more openings to limit the entry of any debris into the housing. The debris barrier housing may be formed from any suitable material such as a metal, a composite, a polymer, and the like.

In an embodiment, the barrier element may be configured to permit communication of at least one parameter at a second location 203 with the interior of the housing while also reducing the amount of debris entering the housing. In various embodiments as described in more detail herein, the barrier element may comprise a plug, piston, a screen, a sleeve, a bladder, at least one opening, and/or at least one object disposed within the housing or communication path 524.

In an embodiment, the debris barrier may optionally comprise a fluid communication medium within the housing. This embodiment may be useful when the parameter being measured at the sensing point includes the pressure. The communication medium may be selected to limit the amount of convective currents within the housing, thereby preventing a bulk flow of fluids that may carry debris into the sensing link and/or the gauge. Any fluid having a sufficient viscosity at the wellbore operating temperatures may be used. In an embodiment, the fluid communication medium may comprise a fluid such as a gel, a grease, and/or a wax having a melting point above the wellbore operating temperatures. The fluid may then act as a semi-solid or highly viscous fluid within the housing. The fluid may allow for the transfer of a pressure force without flowing within the housing. One or more ports may be provided in the sensing link and/or the housing to allow the housing and/or communication path to be filled with the fluid communication medium. In some embodiments, a less viscous fluid may be used such as hydraulic oil, an aqueous fluid, and/or wellbore fluids. The barrier element may then be used to limit the amount of debris entering the housing that could contaminate the fluid and plug the sensing link and/or gauge.

The debris barrier 522 may be coupled to the sensing link using a variety of coupling and/or engagement mechanisms. In an embodiment, the debris barrier may comprise threads configured to engage corresponding threads on the sensing link. Upon engagement of the threads, a sealing engagement may be formed between the debris barrier and the sensing link. The debris barrier 522 may engage the sensing link 204 by aligning the complimentary threads 523 and rotating the housing into engagement. The debris barrier 522 and the sensing link 204 may be disengaged by ratcheting and/or rotating. Other suitable coupling mechanisms may be used in some embodiments. For example, the debris barrier 522 may be welded to the sensing link 204.

As shown in FIG. 6, a sensing link 204 and a debris barrier 522 may be configured to communicate at least one parameter comprising pressure to a pressure gauge. Similar to other embodiments, FIG. 6 depicts that the sensing link 204 comprises at least one sensing point and at least one communication path 524. Additionally, the at least one sensing point may be disposed at the second location 203. FIG. 6 also depicts that the sensing link 204 may be coupled to the debris barrier 522. In this embodiment, the barrier element may comprise a plug 530 disposed within the housing. An opening 534 in the housing may form a seat 532 on an inner surface configured to engage the plug 530. In an embodiment, a fluid may be disposed within the housing to retain the plug adjacent the seat 532, and the plug 530 may be configured to prevent the communication medium 526 from leaving the communication path 524. The plug 530 may provide a barrier preventing debris from entering the communication path 524 through the opening 534. In an embodiment, the plug 530 may comprise any geometric shape, such as, for example, a sphere, cylinder, cone, frusto-conical member, a cube, or the like. The seat 532 may be configured so that the plug 530 may not pass through the opening 534, and the seat 532 may therefore retain the plug 530 within the housing. In an embodiment, the plug 530 may remain on the seat 532 due to the viscosity of the communication medium 526. In order to provide fluid communication past the plug 530, one or more fluid communication paths may be provided between the plug and the seat. In an embodiment, the seat 532 may comprise grooves and/or scratches to allow fluid, or at least fluid pressure, to flow around the plug 530 situated on the seat 532. The fluid may communicate through the opening 534 when, for example, the communication medium 526 is disposed into the communication path 524 through the port 536. In order to dispose the fluid in the housing, the fluid may be injected into the port 536 to fill the sensing link and the debris barrier. The port 536 may then be plugged and/or sealed closed so that the communication medium 526 may not exit the communication path 524 through the port 536.

During operation, a gauge at a first location may be coupled to the debris barrier 522 disposed at a second location 203 using the sensing link. In an embodiment, at least one parameter may be communicated with the opening 511 and the plug 530 situated on the seat 532. The parameter may communicate through the opening 511 and the plug 530, and through the communication path 524. In an embodiment, the parameter may travel through the communication path 524 until it reaches the gauge 202, which may measure the parameter.

Figure 7:
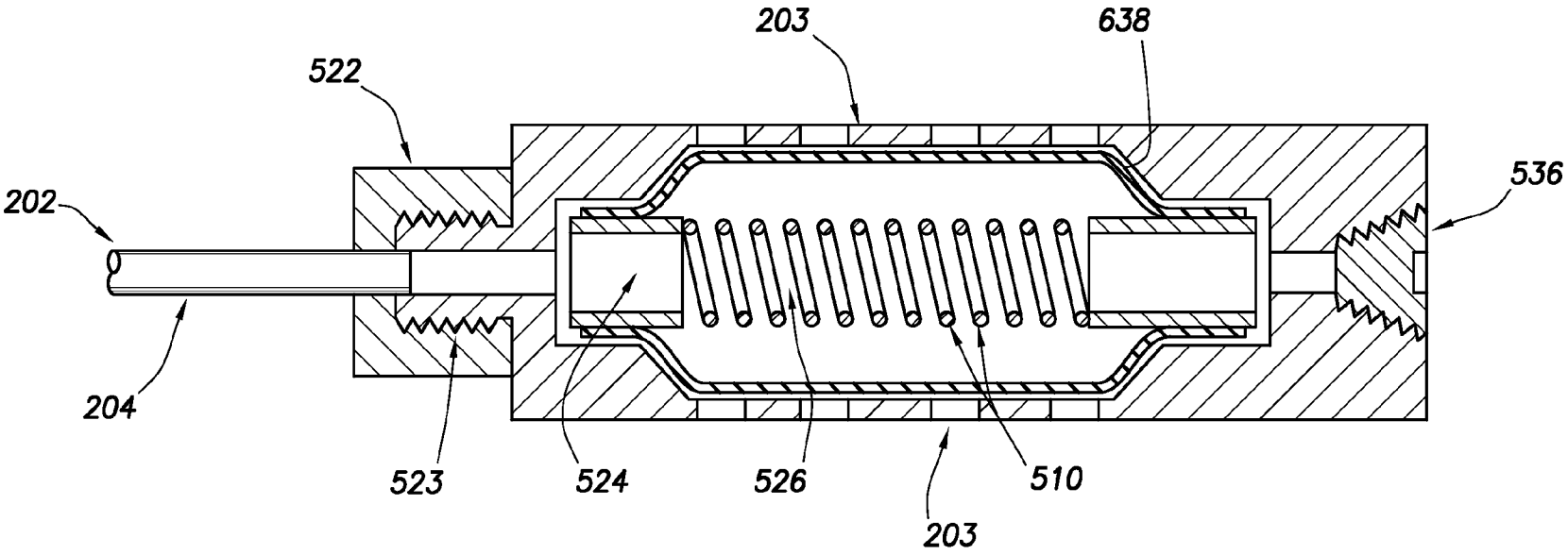
FIG. 7 is a cross-sectional view of an embodiment of a debris barrier.

Turning to FIG. 7, another embodiment of a debris barrier 522 is shown. In this embodiment, the debris barrier and sensing link 204 may be configured to sense a parameter comprising pressure. Similar to other debris barriers, FIG. 7 depicts that the debris barrier 522 comprises a sensing point, a communication path 524, and a bladder 638. In this embodiment, a plurality of sensing points may be disposed about the housing. In an embodiment, the sensing points may comprise a plurality of openings disposed in the housing. The plurality of openings 511 may comprise a plurality of geometric shapes, such as, for example, narrow slots, circle shapes, elliptical shapes, or any other suitable shapes. In some embodiments, one or more of the sensing points may have different cross-section areas depending on their intended purpose. In an embodiment, the cross-sectional area of the sensing points may be configured to minimize the amount to debris that may enter the communication path 524. The sensing points may be spaced about the circumference of the housing.

The barrier element may comprise a bladder 638 disposed within the housing and in fluid communication with the sensing point and/or the exterior of the housing through the openings. The bladder 638 may be configured to retain a communication medium 526 and transfer a force applied to an outer surface of the bladder to the communication medium 526 within the bladder. In order to transfer a force through the bladder, the bladder may be configured to expand and/or contract in response to the application of a force to the bladder. A biasing element (e.g., a spring 510) may be disposed within the bladder to maintain the bladder in an expanded configuration within the bladder 638. The biasing element may also prevent the complete collapse of the bladder due to a large pressure differential between the exterior of the debris barrier and the interior of the debris barrier and/or the loss of a fluid within the communication path. The bladder may substantially prevent fluid communication between an exterior of the bladder and the interior of the bladder, thereby acting as a barrier to debris from entering the communication path. While described in terms of a bladder, other structures capable of providing a volume change to transmit a pressure force may also be used. For example, the bladder may comprise a rubber and/or metal bladder and/or a rubber and/or metal bellows.

During operation, a gauge at a first location may be coupled to the debris barrier 522 disposed at a second location 203 using the sensing link. In an embodiment, at least one parameter may be communicated with the openings 511 and the bladder 638 disposed within the housing. The parameter may communicate through the openings 511 to the bladder 638, which may transfer the parameter to the communication path 524. In an embodiment, the parameter may travel through the communication path 524 until it reaches the gauge, which may measure the parameter.

Figure 8:
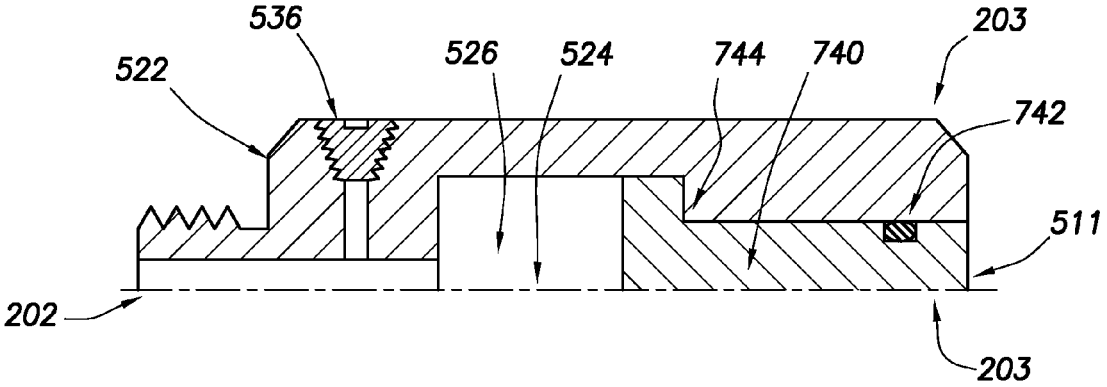
FIG. 8 is a cross-sectional view of an embodiment of a debris barrier.

Turning to FIG. 8, another embodiment of a debris barrier 522 is shown. In this embodiment, the debris barrier 522 and sensing link 204 may be configured to sense a parameter comprising pressure. Similar to other debris barriers, FIG. 8 depicts that the debris barrier comprises a sensing point, a communication path 524, and a barrier element 740. Additionally, in this embodiment, the at least one sensing point 510 may be disposed at an end of the housing. FIG. 8 also depicts that, in an embodiment, the debris barrier may also comprise at least one port 536. The barrier element may comprise a piston 740 slidingly engaged within the housing. The piston 740 may be configured to permit communication of at least one parameter to the communication path 224. One or more seals 742 (e.g., an o-ring seal) may be disposed between the piston and the housing to provide a sealing engagement between the piston and housing and prevent fluid communication around the piston 740 and into the communication path 524. The sealing engagement between the piston and the housing may be configured to provide protection for the communication path 524 from debris within the wellbore annulus. In an embodiment, the cross-section of the piston 740 may comprise any suitable geometric shape. The piston 740 may comprise at least one lip configured to engage at least one piston seat 744. The lip may prevent the piston from passing through the opening at the sensing point. When pressure builds at the sensing point the at least one piston 740 may be translatable within the housing, thereby allowing for the communication of the parameter, for example the pressure, through the piston to the communication medium 526 disposed in the communication path 524. The parameter may be communicated through the communication path 524 until it reaches the gauge 202.

In an embodiment, a communication medium may be disposed in the communication path. The communication medium may comprise a fluid capable of transmitting a parameter such as the pressure to the first location. The communication medium may be disposed in the communication path using a port 536. The communication medium may be flowed into the communication path and the plug may be disposed in the port 536 to retain the communication medium in the communication path.

During operation, a gauge at a first location may be coupled to the debris barrier 522 disposed at a second location 203 using the sensing link. In an embodiment, at least one parameter may be communicated with the openings 511 and the piston 740 disposed within the housing. The parameter may communicate through the openings 511 to the piston 740, which may be translatable in the housing and transfer the parameter to the communication path 524. In an embodiment, a communication medium such as a fluid, may be disposed in the communication path, and the parameter may be transferred from the piston to the communication medium. In an embodiment, the parameter may travel through the communication path 524 until it reaches the gauge 202, which may measure the parameter.

Figure 9:
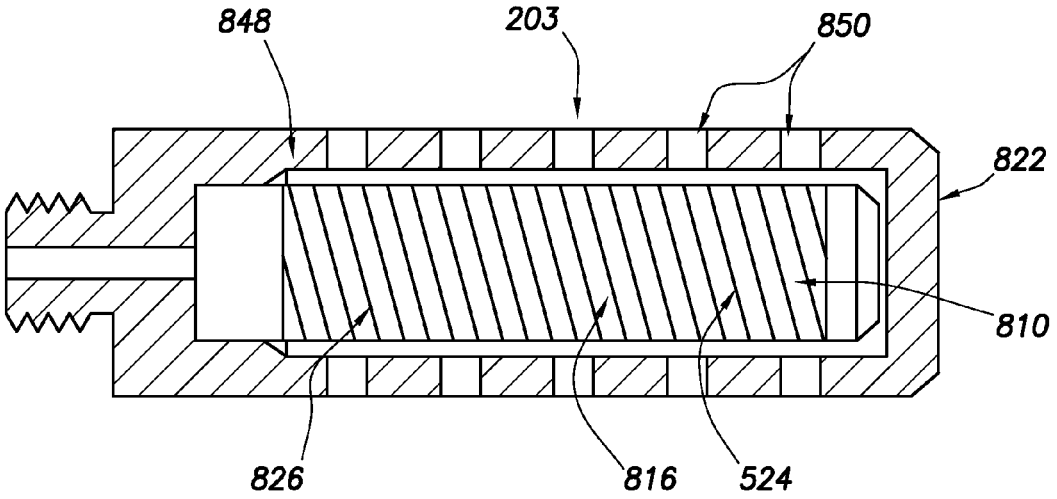
FIG. 9 is a cross-sectional view of an embodiment of a debris barrier.

Turning to FIG. 9, another embodiment of a debris barrier 822 is shown. In this embodiment, the debris barrier 822 and sensing link may be configured to sense a parameter comprising pressure. FIG. 9 depicts that the debris barrier comprises a sensing point, a communication path 524, and barrier element. The barrier element may comprise at least one strainer 816. The strainer 816 may be configured to permit communication of at least one parameter through the communication path 524. The strainer 816 may be disposed within the housing 848 and serve to filter one or more particulates from a fluid entering the fluid communication path. Various suitable structures may be used to form the strainer 816. In an embodiment, the strainer 816 may comprise a wire wrap, a mesh, a cloth, a synthetic fiber, a slotted tube, a perforated tube, and/or any other permeable material. In an embodiment, the strainer 816 may comprise a plurality of strainer layers, and each layer may be the same or different. For example, a plurality of layers may comprise decreasing pore sizes from the outer layer to the inner layer, which may provide a rough filter on the outer layers and a finer filter on the inner layers. In an embodiment, the housing 848 may comprise one or more openings to provide fluid communication from the wellbore to the strainer 816. The openings may serve as a filter element to initially prevent large particulates from entering the debris barrier and engaging the strainer 816.

During operation, a gauge at a first location may be coupled to the debris barrier 822 disposed at a second location 203 using the sensing link. In an embodiment, at least one parameter may be communicated with the openings 850 and the strainer 816 disposed within the housing 848. The parameter may communicate through the openings 810 in the housing to the strainer 816, which may filter out at least a portion of any particulates in the fluid. In an embodiment, a communication medium, may be disposed in the communication path, and the parameter may be transferred from the wellbore to the communication medium through direct fluid contact passing through the strainer 816. In an embodiment, the parameter may travel through the communication path 524 until it reaches the gauge 202, which may measure the parameter. When a communication medium is used, the parameter may be communicated along the communication path without a bulk flow component. This may limit the amount of fluid passing through the strainer 816, and aid in limiting the degree to which the strainer 816 may clog over time.

Figure 10A:
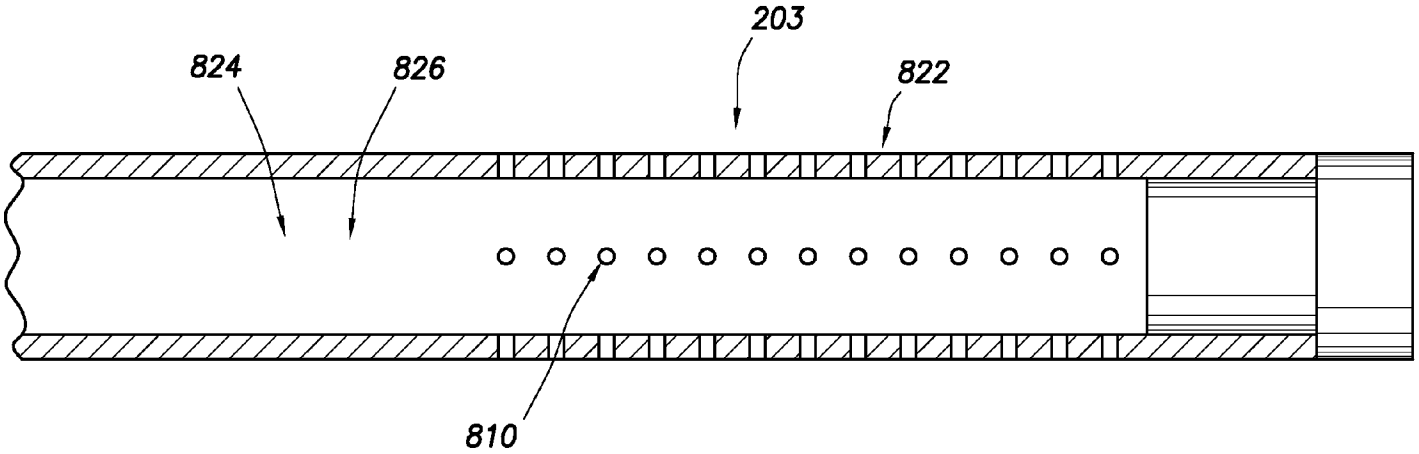
FIGS. 10A and 10B are views of an embodiment of a debris barrier.
Figure 10B:
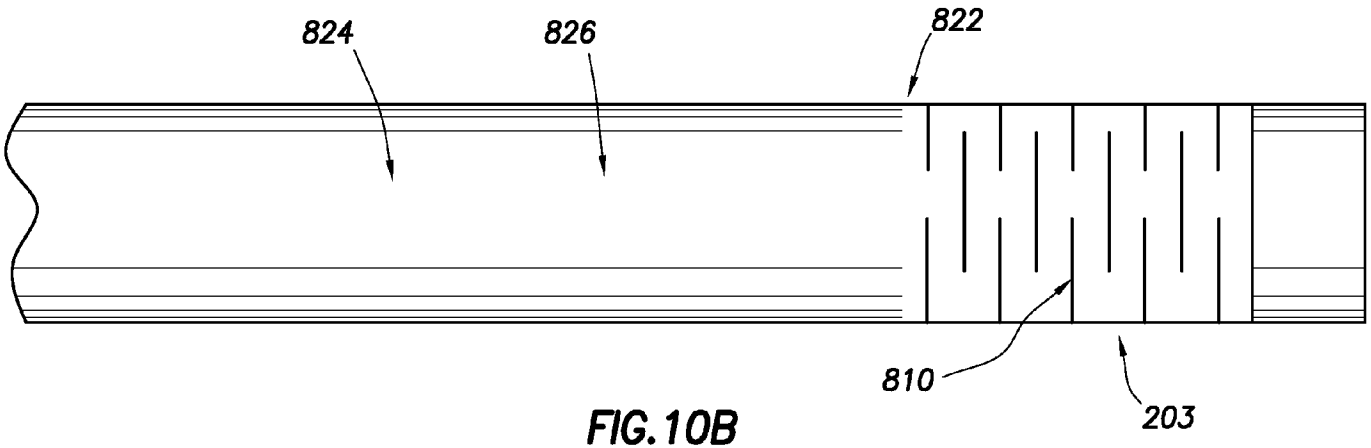
Figure 11:
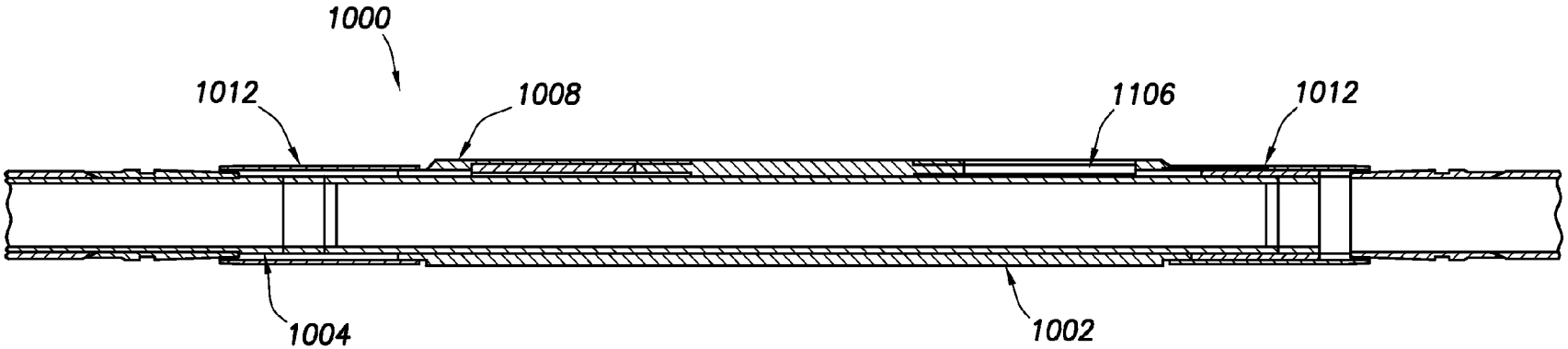
FIG. 11 is a cross-sectional view of an embodiment of a gauge carrier.
Figure 12:
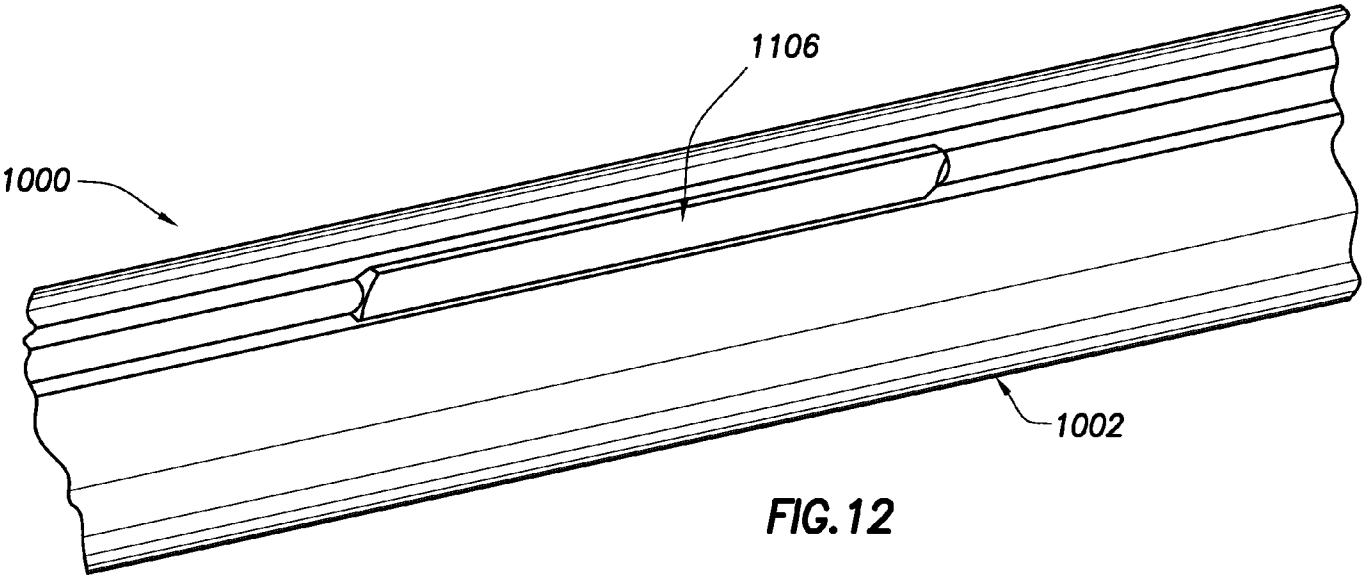
FIG. 12 is a schematic side view of an embodiment of a gauge carrier.
Figure 13:
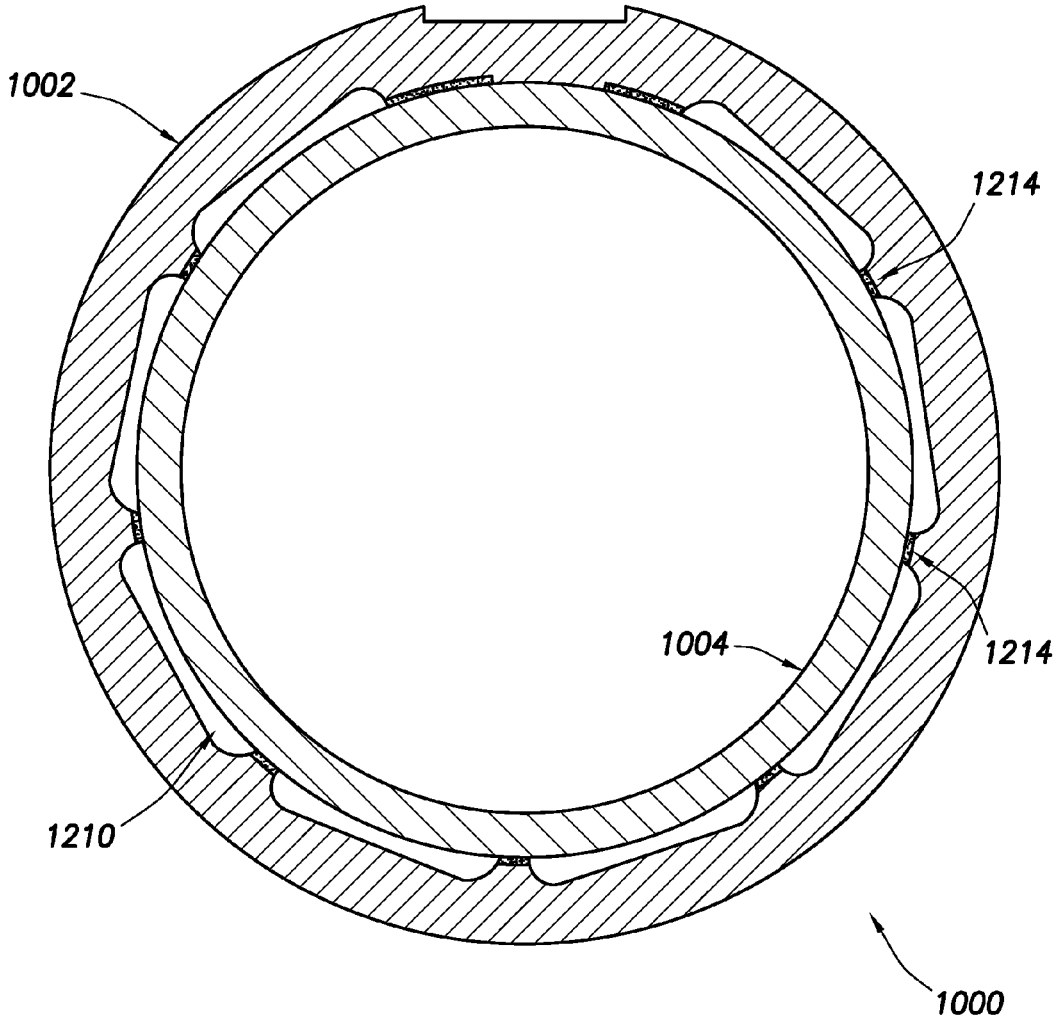
FIG. 13 is a cross-sectional view of an embodiment of a gauge carrier.
Figure 14:
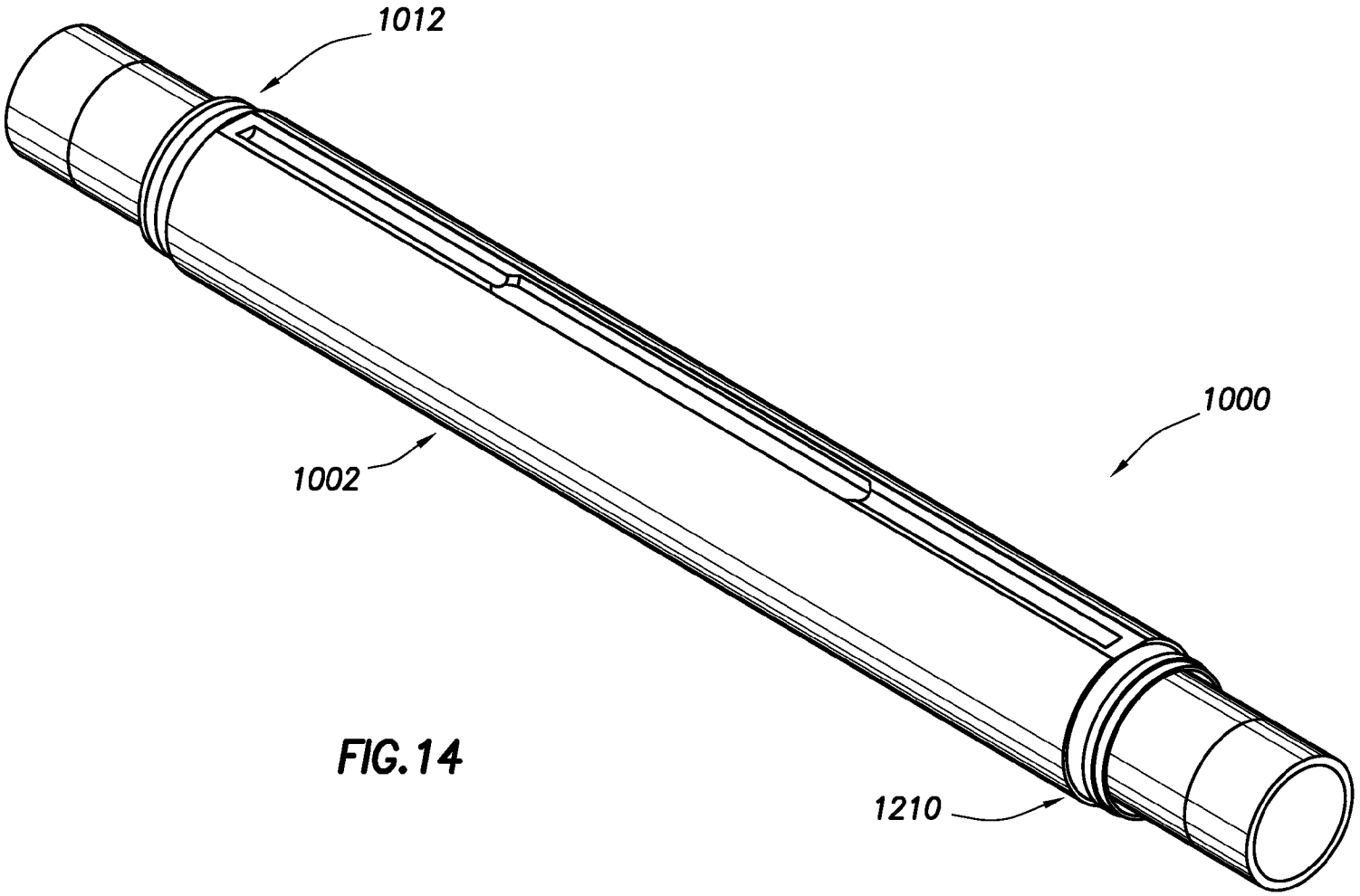
FIG. 14 is a schematic side view of an embodiment of a gauge carrier.
Figure 15:
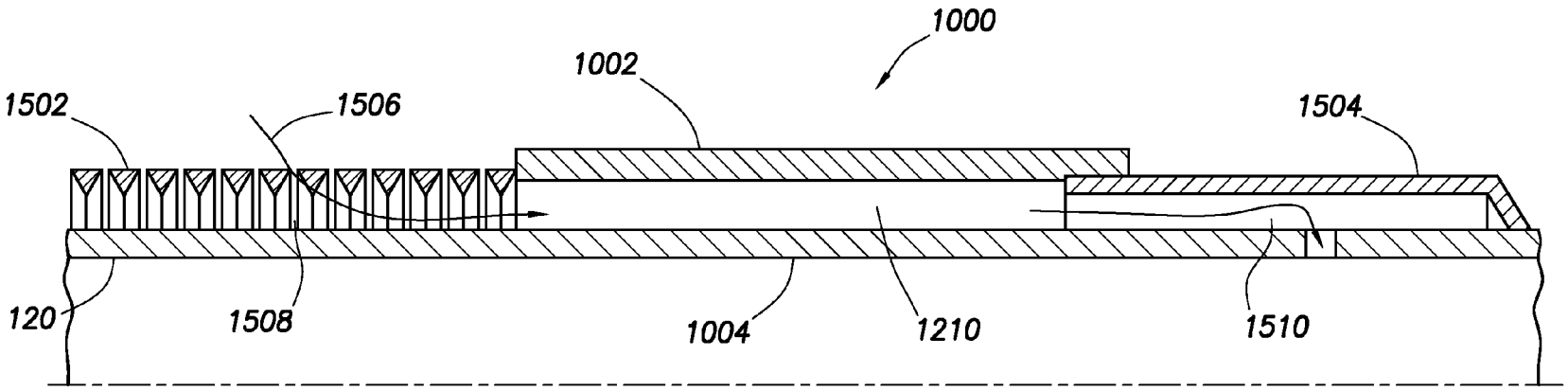
FIG. 15 is a schematic cross-sectional view of an embodiment of a gauge carrier disposed in a wellbore tubular string.

Turning to FIGS. 10A and 10B, another embodiment of a debris barrier 822 is shown. In this embodiment, the debris barrier 822 and sensing link may be configured to sense a parameter comprising pressure. In this embodiment, the debris barrier comprises a portion of the sensing link, so that the debris barrier and sensing link are integrally formed. A plug may be disposed in the end of the sensing link to provide a substantial barrier to fluid flow through the end of the sensing link. One or more openings 810 may then be disposed in the sensing link adjacent the plug to provide fluid communication between the outside of the sensing link (e.g., the surrounding wellbore) and the communication path 824. The plurality of openings 810 may comprise a plurality of geometric shapes, such as, for example, narrow slots, circle shapes, elliptical shapes, or any other suitable shapes. In an embodiment, such as depicted in FIG. 10B, the openings 810 may be disposed around the sensing link. In some embodiments, the slots may be disposed longitudinally along the sensing link. The openings 810 may be configured to filter debris from the fluid communicating with the sensing link and also permit communication of at least one parameter through the communication path 824. The openings 810 may generally be disposed adjacent the end of the sensing link to any suitable distance away from the end. In some embodiments, the openings 810 may be disposed over the sensing link a distance representative of the area in which the pressure is to be measured.

During operation, a gauge at a first location may be coupled to the debris barrier 822 disposed at a second location 203 using the sensing link. In an embodiment, at least one parameter may be communicated with the openings 810 in the sensing link, which may have the plug disposed in the end thereof. The parameter may communicate through the openings in the sensing link, which may filter out at least a portion of any particulates in the fluid. In an embodiment, a communication medium may be disposed in the communication path, and the parameter may be transferred from the wellbore to the communication medium through direct fluid contact through the openings. In an embodiment, the parameter may travel through the communication path 824 until it reaches the gauge 202, which may measure the parameter. When a communication medium is used, the parameter may be communicated along the communication path without a bulk flow component. This may limit the amount of fluid passing through the strainer 816, and aid in limiting the degree to which the opening may clog over time.

In an embodiment, method of protecting at least one sensing assembly and/or sensing system 200 is disclosed. A method of protecting at least one sensing assembly and/or sensing system 200 may comprise disposing at least one sensing assembly and/or sensing system 200 within a wellbore. A debris barrier 822 may be coupled to the sensing assembly and/or sensing system 200. The debris barrier communication medium 826 may be disposed within the communication path 824 and/or the debris barrier using one or more ports 536 in the sensing link and/or the debris barrier. A parameter may then be communicated from the debris barrier, through the communication path, to a gauge.

In an embodiment, a gauge carrier may be used to retain one or more gauges along the wellbore tubular string. The gauge carrier may serve to retain and/or protect the gauge will being conveyed within the wellbore and during production. In addition to retaining the gauge or gauges, the gauge carrier described herein may also allow for an annular flow between an outer housing and a mandrel. The annular flow path may then be coupled to a corresponding annular flow path on one or more adjacent components to provide a flow path through the gauge carrier. This may allow the gauge carrier described herein to be used between adjacent components such as screens, production sleeves, and the like.

In an embodiment as shown in FIGS. 11 to 15, a gauge carrier 1000 may be configured to retain at least one gauge 202 about a wellbore tubular member (e.g., as shown in FIGS. 2A and 2B). The gauge carrier 1000 may also be configured to retain additional sensing system components or portions of the sensing system components such as the manifolds, communication components, sensing links, and/or any bypass lines. In an embodiment, the gauge carrier 1000 comprises a housing 1002 disposed about a mandrel 1004, and at least one flow path 1210 (shown in FIG. 13) formed between the housing 1002 and the mandrel 1004. The housing 1002 may be configured to be disposed around a mandrel 1004, which may be a wellbore tubular and/or be configured to engage at least one wellbore tubular member (e.g., using a threaded connection). The housing generally comprises a tubular component having a first end and second end. A flowbore extends through the housing between the first end and the second end. One or more pockets may be disposed in the housing. The pockets generally comprise an indentation and/or opening in the housing configured to receive a gauge on the outer surface of the housing. The indentation may be formed using any suitable method including milling, welding, forming, and/or cutting a hole in the housing. The edges of the indentation and/or hole may then be sealed to the mandrel 1004, for example, by welding the edges to the mandrel 1004. In some embodiments, a separate component may be sealingly engaged within the hole to form the pocket. The housing, including the pocket, may substantially prevent fluid communication between the exterior of the housing 1002 and the annular region formed between the housing 1002 and the mandrel 1004. In an embodiment, the pocket 1106 may engage the mandrel 1004 and be substantially sealed from the annular region formed between the housing 1002 and the mandrel 1004. In an embodiment, the pocket 1106 may be formed longitudinally along the outside diameter of the gauge housing 1002. In some embodiments, a plurality of pockets 1106 may be disposed about the circumference of the housing to receive one or more gauges or other components of the sensing assembly. The housing 1002 may also comprise a channel and/or a path for the sensing links to extend from the gauge carrier to the sensing point. The channel and/or path may comprise bores through the housing 1002 and/or grooves longitudinally disposed along the housing 1002. These channels and/or grooves may be configured to house the sensing link along the length of the housing 1002.

The housing 1002 may be disposed about the mandrel 1004. The mandrel 1004 may generally comprise a tubular component having a first end and a second end. A flowbore may extend through the center of the mandrel 1004 to provide a fluid communication pathway between the first end and the second end. The flowbore may be sized to provide a desired flow area through the mandrel 1004, and in an embodiment, the mandrel 1004 may be sized to correspond to one or more adjacent wellbore tubulars. The first end and/or the second end may be coupled to adjacent wellbore tubular sections using any suitable connection mechanisms such as corresponding threads. When disposed about the mandrel 1004, an annular space may be defined between the inner surface of the housing and the outer surface of the mandrel. The annular space may define a flow path 1210 between the first end and the second end of the annular space, which may correspond to the first end and/or second end of the housing 1002.

In order to maintain the orientation of the housing 1002 about the mandrel 1004, one or more standoffs 1214 may be disposed between the housing 1002 and the mandrel 1004. In some embodiments, a plurality of standoffs 1214 may be engaged between the mandrel 1004 and the housing 1002. The standoffs 1214 may generally comprise longitudinal fins or legs extending between the housing 1002 and the mandrel 1004. The one or more standoffs 1214 may generally be disposed longitudinally between the housing 1002 and the mandrel 1004, though other configurations are possible such as spiral standoffs, helical standoffs, or the like. In some embodiments, the standoffs 1214 may comprise spacers extending between the housing 1002 and the mandrel 1004 and may not extend along the length of the mandrel 1004. For example, the standoffs may comprise pillar type standoff or supports, or the like. In an embodiment, the standoff 1214 may be configured to channel fluid through the annular space 1210. The one or more standoffs 1214 may be integrally formed with the housing 1002 and/or the mandrel. The one or more standoffs 1214 may be fixedly attached to the inside diameter of the housing 1002, for example using welds, sealants, coupling mechanisms, and/or the like.

Returning to FIG. 11, the gauge carrier 1000 may comprise one or more covers 1008 configured to engage a pocket 1106. The cover 1008 may be configured to protect a gauge disposed in the pocket 1106 from debris, erosion from high rate pumping of proppant, and/or damage during installation within the wellbore annulus. In an embodiment, the cover 1008 may be configured to allow fluid communication between the gauge disposed in the pocket 1106 and the wellbore annulus, which may allow one or more parameters to be measured by a gauge disposed within the pocket 1106. The cover 1008 may be disposed over the pocket and engaged to the outside surface of the gauge housing 1002. In some embodiments, the cover 1008 may be disposed within an edge disposed around the opening of the pocket 1106, and/or the cover 1008 may be releasable or slidingly engaged with the housing over the pocket. The cover may be engaged with the housing any suitable connectors including, but not limited to, fasteners such as screws, bolts, pins, rivets, welds, clips, or the like.

The flow path 1210 between the housing 1002 and the mandrel 1004 may be coupled to a corresponding flow path 1508, 1510 through one or more adjacent components. In an embodiment shown in FIG. 15, an annular flow path 1508 may extend between a filter element 1502 (e.g., a screen) and the wellbore tubular 120 over which the filter element 1502 is disposed. Similarly, a production sleeve 1504 may comprise an annular flow path 1510 between an outer housing and a wellbore tubular 120. Fluid 1506 may then be allowed to flow through the filter element 1502, into the flow path 1508 between the filter element 1502 and the wellbore tubular 120, through the annular flow path 1210 in the gauge carrier 1000, into the flow path 1510 in the production sleeve 1504, and enter the central flowbore within the wellbore tubular 120. The housing 1002 may be configured to engage one or more adjacent components 1502, 1504 to allow the flow path 1210 to couple to one or more adjacent flow paths 1508, 1510 in an adjacent component 1502, 1504. In an embodiment, the housing 1002 may be configured to engage a screen 1502 and/or a production sleeve 1504, though the annular flow path 1210 may be coupled to an annular flow path on any wellbore component as described herein. The engagement with the adjacent component 1502, 1504 may comprise a sealing engagement so that the annular flow path 1210 is isolated from the exterior of the housing 1002. This may provide a sealed flow path between one or more components coupled to the gauge carrier.

In order to provide a sealing engagement between the housing and an adjacent component, the housing may comprise a sealing sleeve 1012 disposed at least at one end of the housing 1002. In an embodiment, the sealing sleeve 1012 may be configured to prevent direct fluid communication between the wellbore annulus and the flow path 1210 (shown in FIG. 13). In an embodiment, the sealing sleeve 1012 may be configured to seal the outside diameter of the housing 1002 with the outside diameter of an adjacent component (e.g., a filter element, a production sleeve, a second gauge carrier, etc.). In this embodiment, complimentary ridges or threads may be disposed on the sealing sleeve 1012 and the tubular member. The sealing sleeve ridge and the tubular member ridge may engage so that sealing sleeve 1012 may seal with the tubular member. In an embodiment, the complimentary threads may be ratcheted over each other to engage the filter element with the housing 1002. In an embodiment, the housing 1002 may engage the filter element by aligning the complimentary threads and rotating the gauge housing in the counter clockwise or clockwise direction. In some embodiments, the sealing sleeve may be engaged with an adjacent component, and the sealing sleeve may be configured to be crimped to the adjacent component, thereby forming a sealing engagement with the adjacent component.

During the formation of the wellbore tubular string, the gauge carrier 1000 may be disposed along the wellbore tubular string. The housing may then be disposed adjacent another component comprising an annular flow path. A sealing sleeve may be positioned in engagement with the housing and the adjacent component, and a tool may engage and activate the sealing sleeve 1012. By activating the sealing sleeve 1012 an annular flow path may be created along the wellbore tubular between the components. In an embodiment, the sealing sleeve 1012 may engage an adjacent wellbore component while engaging the gauge carrier 1000 with the tubular string. The sealing sleeve 1012 may engage the adjacent component at the same time the gauge carrier 1000 engages with tubular member. In this embodiment, the complimentary threads disposed on the sealing sleeve 1012 and the outside diameter of tubular member may be ratcheted and/or rotated into sealing engagement at the same time the gauge carrier 1000 is ratcheted and/or rotated into axial engagement with other wellbore tubular member.

In an embodiment, method of sensing in a wellbore is disclosed. In an embodiment, a gauge carrier 1000 may be engaged with a wellbore tubular member, for example as part of a wellbore tubular string (e.g., a completion string or assembly, a production string or assembly, etc.). One or more components of a sensing assembly and/or sensing system 200 may be disposed within the gauge carrier, wherein the sensing assembly and/or sensing system 200 is configured to measure at least one parameter in a wellbore. For example, a gauge may be disposed in a pocket. In an embodiment, the sensing assembly and/or the gauge may be used to sense a parameter that is adjacent (e.g., in radial alignment with) at least one wellbore component (e.g., a filter element), within a wellbore tubular string, within an annular flow path, and/or adjacent the sensing assembly. A fluid may be in fluid communication with the annular space between the housing of the gauge carrier and the mandrel about which the housing is disposed. For example, the fluid may be flowing through the annular space during the sensing of the one or more parameters.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A wellbore sensing system comprising:

a wellbore tubular string comprising at least one gauge carrier and at least one longitudinally adjacent component, wherein the at least one gauge carrier is configured to provide an annular fluid communication between a housing and a mandrel, wherein the at least one gauge carrier is sealingly engaged with the at least one longitudinally adjacent component, wherein the at least one adjacent component comprises at least one of a filter element or a production sleeve; and at least one gauge disposed in the gauge carrier, wherein the at least one gauge is disposed in a pocket on an outside of the housing, wherein the at least one gauge is configured to sense at least one parameter within a wellbore, wherein the at least one gauge carrier further comprises channels configured to retain one or more sensing links.

2. The system of claim 1, wherein the wellbore tubular string comprises a filter element disposed about a wellbore tubular longitudinally adjacent the at least one gauge carrier, and wherein an annular flow path between the filter element and the wellbore tubular is in fluid communication with a flowpath between the housing and the mandrel.

3. The system of claim 2, further comprising a sensing point disposed radially adjacent the filter element, wherein the sensing point is coupled to the at least one gauge, and wherein the at least one gauge is configured to measure at least one parameter at the sensing point.

4. The system of claim 1, wherein one or more standoffs are disposed between the housing and the mandrel.

5. The system of claim 1, further comprising a communication component coupled to the at least one gauge, wherein the communication component is configured to communicate a signal indicative of a parameter to a surface of the wellbore.

6. The system of claim 1, wherein the at least one gauge is configured to sense the at least one parameter adjacent the at least one gauge carrier.

7. The system of claim 1, wherein the at least one gauge is configured to sense the at least one parameter at a location that is longitudinally separated from the at least one gauge.

8. The system of claim 1, wherein the at least one gauge is configured to sense the at least one parameter within an annular space between the housing and the mandrel.

9. The system of claim 1, wherein the at least one gauge is configured to sense the at least one parameter within the wellbore tubular string.

10. The system of claim 1, further comprising a plurality of gauges disposed in the gauge carrier; wherein the plurality of gauges is configured to sense at least one parameter at a plurality of locations within the wellbore, wherein the plurality of locations comprise at least two of a location adjacent the at least one gauge carrier, a location longitudinally separated from the plurality of gauges, an annular space between the housing and the mandrel, or a location within the wellbore tubular string.

11. A gauge carrier comprising:

a housing disposed about a mandrel;

an annular space formed between the housing and the mandrel, wherein the annular space is configured to provide fluid communication between a first end of the housing and a second end of the housing;

at least one pocket configured to receive a gauge, wherein the pocket is disposed on an outside of the housing, and wherein the housing is configured to substantially seal the at least one pocket from the annular space; and channels configured to retain one or more sensing links.

12. The gauge carrier of claim 11, further comprising the gauge disposed in the at least one pocket.

13. The gauge carrier of claim 11, further comprising one or more standoffs disposed between the housing and the mandrel.

14. The gauge carrier of claim 11, further comprising at least one cover disposed over the at least one pocket.

15. The gauge carrier of claim 11, wherein the housing comprises a sealing sleeve, wherein the sealing sleeve is configured to engage an adjacent component.

16. A method of sensing in a wellbore, the method comprising:

retaining at least one gauge along a wellbore tubular string using a gauge carrier, wherein the gauge carrier comprises a housing disposed about a mandrel, wherein an annular flowpath is formed between the housing and the mandrel, wherein the at least one gauge is disposed about an outside of the housing;

communicating fluid through the annular flowpath; and sensing at least one parameter using the at least one gauge, wherein the at least one parameter is provided through a sensing link from a point axially separate from the gauge carrier.

17. The method of claim 16, further comprising receiving a fluid within the annular flowpath from a second annular flowpath on an adjacent component.

18. The method of claim 17, further comprising passing the fluid from the annular flowpath to a third annular flowpath on an adjacent component.

19. The method of claim 18, wherein at least one of the second annular flowpath or the third annular flowpath is formed between a filter element and a wellbore tubular.

* * * * *